US005400966A

United States Patent [19]

Weaver et al.

[11] Patent Number: 5,400,966

[45] Date of Patent: Mar. 28, 1995

[54] MACHINE FOR MAKING ARTIFICIAL SNOW AND METHOD

[75] Inventors: Timothy J. Weaver, Great Valley, N.Y.; David B. Riley, Erie, Pa.; William B. Smith, Jr., Akron, Ohio; Donald Cutler, Warren, Pa.

[73] Assignee: Holimont, Inc., Ellicottville, N.Y.

[21] Appl. No.: 102,555

[22] Filed: Aug. 5, 1993

[51] Int. Cl.[6] ..... F25C 3/04

[52] U.S. Cl. ..... 239/202; 239/14.2

[58] Field of Search ..... 239/2.2, 14.2, 135

[56] References Cited

U.S. PATENT DOCUMENTS

| | | | |
|---|---|---|---|
| 3,814,319 | 6/1974 | Loomis | 239/2 |
| 3,945,567 | 3/1976 | Rambach | 239/14 |
| 3,964,682 | 6/1976 | Tropeano et al. | 239/14.2 X |
| 3,979,061 | 8/1976 | Kircher | 239/2 |
| 4,083,492 | 4/1978 | Dewey | 239/14.2 X |
| 4,105,161 | 8/1978 | Kircher et al. | 239/2 |
| 4,214,700 | 7/1980 | Vanderkelen et al. | 239/2 |
| 4,222,519 | 9/1980 | Kircher et al. | 239/14.2 |
| 4,223,836 | 9/1980 | Eager | 239/14.2 X |
| 4,493,457 | 1/1985 | Dilworth et al. | 239/25 |
| 4,572,636 | 3/1986 | Dilworth et al. | 239/14.2 X |
| 4,593,854 | 6/1986 | Albertsson | 239/2 |
| 4,682,729 | 7/1987 | Doman et al. | 239/14.2 X |
| 4,711,395 | 12/1987 | Handfield | 239/14 |
| 4,813,598 | 3/1989 | Kosik, Sr. et al. | 239/14.2 X |
| 4,823,518 | 4/1989 | Dilworth et al. | 52/40 |
| 4,919,331 | 4/1990 | Kosik, Sr. et al. | 239/14.2 X |
| 4,993,635 | 2/1991 | Dupre | 239/14 |
| 5,031,832 | 7/1993 | Ratnik et al. | 239/14 |
| 5,135,167 | 8/1992 | Ringer | 239/14 |
| 5,167,367 | 12/1992 | Vanderkelen et al. | 239/14.2 X |

FOREIGN PATENT DOCUMENTS

| | | | |
|---|---|---|---|
| 1174064 | 9/1984 | Canada | 239/14.2 |
| 494380 | 7/1992 | European Pat. Off. | 239/14.2 |
| 2634663 | 2/1990 | France | 239/14.2 |
| 2501670 | 8/1975 | Germany | 239/14.2 |
| 4295574 | 10/1992 | Japan | 239/14.2 |

*Primary Examiner*—Andres Kashnikow
*Assistant Examiner*—Lesley D. Morris
*Attorney, Agent, or Firm*—Hodgson, Russ, Andrews, Woods & Goodyear

[57] ABSTRACT

An improved tower mounted snow making machine (10) that provides for covering a ski slope (48) with artificial snow (50) is described. The snow making machine comprises a housing (12) having a frusto-conical section (84) that provides for maintaining the generated velocity of a high-volume air flow out through a discharge outlet (12A) and with a nucleator (16) disposed inside the housing to generate a wide angle round spray pattern of ice crystal nuclei (21) that diverge towards the discharge outlet without impinging on the inside of the housing. A spray nozzle manifold (22) is mounted annularly around the discharge outlet and supports a plurality of water nozzles comprising primary water nozzles (116A to 116F) that are automatically actuated when the machine is turned on to inject a primary water shower into the air flow, which water shower commingles with the ice crystal nuclei to thereby form ice granules as the two travel through the cold ambient air, and secondary water nozzles (118A to 118K) that are selectively actuatable to augment the primary water shower. The snow making machine can be mounted on a tower like support structure that provides for adjusting the discharge direction and tilt angle of the discharge outlet from a ground level elevation.

125 Claims, 5 Drawing Sheets

MACHINE FOR MAKING ARTIFICIAL SNOW AND METHOD

BACKGROUND OF THE INVENTION

1. Field Of The Invention

The present invention relates to a method, and machine for making artificial snow and more particularly to an improved method and machine for making large quantities of high quality, granular snow. The present snow making machine is further able to throw the snow a substantial distance from the machine in a wide area coverage pattern, but without creating unacceptable decibel sound levels. 2. Prior Art The increasing popularity of winter skiing activities and the like, and the unpredictability of seasonal weather conditions has provided ample impetus for constructing snow making machines that produce large quantities of artificial snow. Snow making machines make it possible for ski slope operators to augment the naturally occurring snow fall thereby extending the skiing season both in the fall and during the spring months. However, one of the problems inherent in many of these prior art snow making machines is that they do not provide uniform spacing and distribution of ice crystal nuclei in the air flow through the machine. This decreases the efficiency or volume output of the snow making process. Representative of this type of prior art snow making machine is shown in U.S. Pat. No. 4,573,636 to Dilworth et al., which describes an apparatus having a pair of seeder nozzles disposed at a 90 degree included angle in a horizontal plane proximate the discharge outlet of the apparatus. The two seeder nozzles thereby generate a relatively flat fan of nucleated ice crystals horizontally across a generated air stream with the nucleated particles contacting a bulk cold water shower produced by two groups of water nozzles, one positioned above and one positioned below the fan of ice crystals. The problem is that these seeder nozzles provide an inadequate discharge pattern above and below the horizontal plane and the generated ice crystals are incapable of completely commingling with the bulk water shower droplets. This incomplete commingling compromises the cooling process of the bulk water droplets and results in incomplete formation of ice granules.

U.S. Pat. No. 4,223,836 to Eager describes a snow making apparatus having a conical shaped collar leading to the discharge outlet. The intended purpose of this collar is to increase the turbulence and therefore the cooling capacity of the emitted air stream. The problem is that generating high volumes of air flow represents a significant portion of the cost of making artificial snow. Creating turbulence in the air stream, therefore, results in decreased velocity at the discharge outlet which compromises the bulk water travel time through the ambient atmosphere and the throw distance of the resulting ice crystals.

U.S. Pat. No. 4,813,598 to Kosik, Sr. et al. discloses water nozzles arranged in four groups spaced annularly around the circumference of the discharge outlet. However, these nozzles are oriented in such a manner that the nucleated ice crystals initially contact the water shower at least ten feet from the nucleator mounted at the discharge outlet. This configuration compromises the commingling between ice crystals and the bulk water shower droplets with a concomitant reduction in the quality of the formed ice crystals.

SUMMARY OF THE INVENTION

The snow making machine of the present invention is an improvement over previous snow making machines and comprises a circular cross-sectioned housing having an inlet opening and a discharge outlet opening. A frusto-conical portion of the housing tapers downwardly and inwardly towards the discharge outlet and is provided with an air flow generator, i.e., such as a fan unit generator, and an ice crystal nucleator disposed therein. The nucleator is a unitary member having a dome shaped spray head positioned along the housing axis and provided with a plurality of openings uniformly spaced around the axis. The spray head produces a wide angle round spray pattern of nucleated ice crystals diverging radially from the nucleator as they travel along the inside of the housing towards the discharge outlet. Alternatively, the housing comprises a cylindrical member having a frusto-conical nose section attached thereto and leading to the discharge outlet.

A plurality of selectively actuatable water nozzles are disposed annually around the discharge outlet and positioned such that their discharge orifices are directly adjacent to the air flow exiting the discharge outlet without being contacted by the air flow. The water nozzles serve to provide a bulk water shower that commingles with the spray of nucleated ice crystals. The ice crystals serve to break the surface tension of the bulk water droplets to let the crystallization process begin. This in turn benefits the seeding effect of the water droplets on the ice crystals to thereby form deposited ice granules. The taper of the frusto-conical housing also serves to maintain the generated air flow at a substantially constant velocity from the fan unit to the discharge outlet to help propel the bulk water spray and ice crystal nuclei through the ambient atmosphere. The maintained air flow velocity thus benefits bulk water and ice crystal "hang time" to optimize the commingling of the two and the resulting ice crystal formation. The result is a fully developed, granular crystal of snow that can be propelled a substantial distance from the snow making machine. Additionally, providing the nucleator at a position inside the housing, spaced from the discharge outlet enables the housing to muffle the sound generated by the nucleator to provide a lower decibel level emitted by the present snow making machine as compared to previous machines.

The snow making machine of the present invention can be mounted on a tower-like support structure permanently positioned adjacent a ski slope and the like, or the snow machine can be supported on a portable frame for moving the machine from one location to another. In the tower mounted machine, the controls for powering-up the nucleator, fan and the water nozzles are positioned so that they can be operated from ground level or remotely. Additionally, in the tower mounted machine, the tilt angle and discharge direction are adjustable from ground level or remotely. Furthermore, the support tower can also provide for lowering the snow making machine to perform maintenance thereon.

Objects

It is therefore an object to provide an improved snow making machine and method to thereby generate large quantities of high quality, granular snow.

It is another object to provide an improved snow making machine and method which efficiently optimizes the energy requirements input into the snow making machine to produce large quantities of high quality, granular snow that are able to be deposited a substantial distance from the snow making machine and in a wide area coverage pattern.

Yet another object is to provide an improved snow making machine that is mountable on a tower like support structure and that can be actuated from ground level to thereby generate large quantities of high quality, granular snow without requiring an operator to climb the support structure to operate the machine. Additionally, the efficiency with which the ice crystals commingle with the bulk water shower droplets enables the vertical elevation of the discharge to be adjusted to more effectively cover a particular section of a ski slope and the like without compromising ice granule formation, Another object is to provide an improved snow making machine that is mountable on a tower like support structure and that is adjustable from ground level or remotely to vary the tilt angle and direction of the discharge outlet without requiring an operator to climb the support structure.

Furthermore, another object is to provide an improved tower mounted snow making machine that can be actuated from ground level or remotely to generate large quantities of high quality, granular snow without requiring an operator to climb the support structure, but which can be raised and lowered on the support structure from ground level for performing maintenance on the snow making machine.

Still another object is to provide an improved snow making machine that operates at a lower decibel level than previously known snow making machines.

These and other objects will become increasingly more apparent to those of ordinary skill in the art by reference to the drawings and the following description.

IN THE DRAWINGS

FIG. 1 is a front elevational view of the snow making machine 10 of the present invention shown looking into a discharge outlet 12A of the machine housing 12.

FIG. 1A is a front elevational view of a spray water manifold 22 supporting primary water nozzles 116A to 116F and secondary water nozzles 118A to 118 K and a nucleator 16 as shown in FIG. 1, but with the housing 12 removed for clarity.

Figure 5:
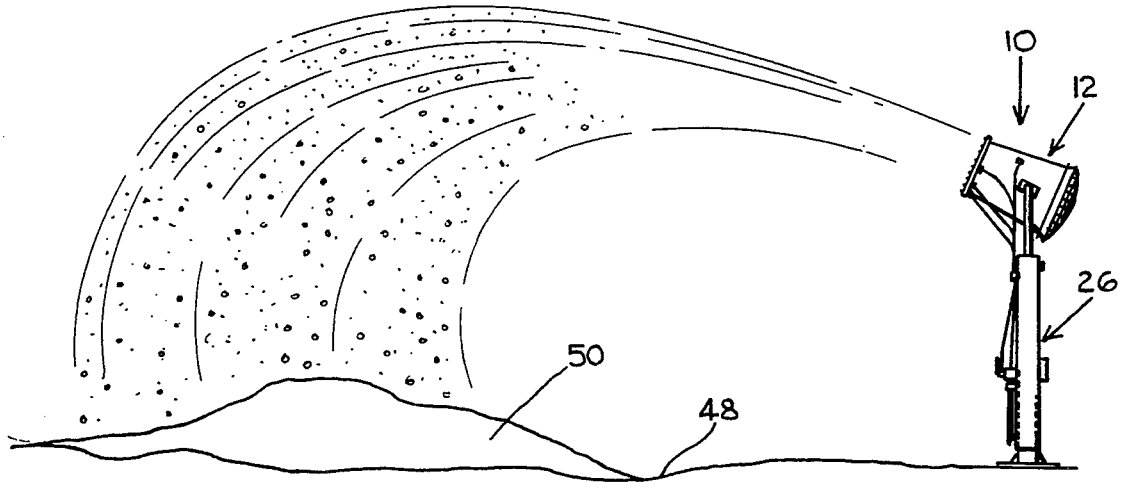

FIG. 5 is a schematic view of the snow making machine 10 of the present invention discharging artificial snow 50 to cover a ski slope 48.

Figure 6:
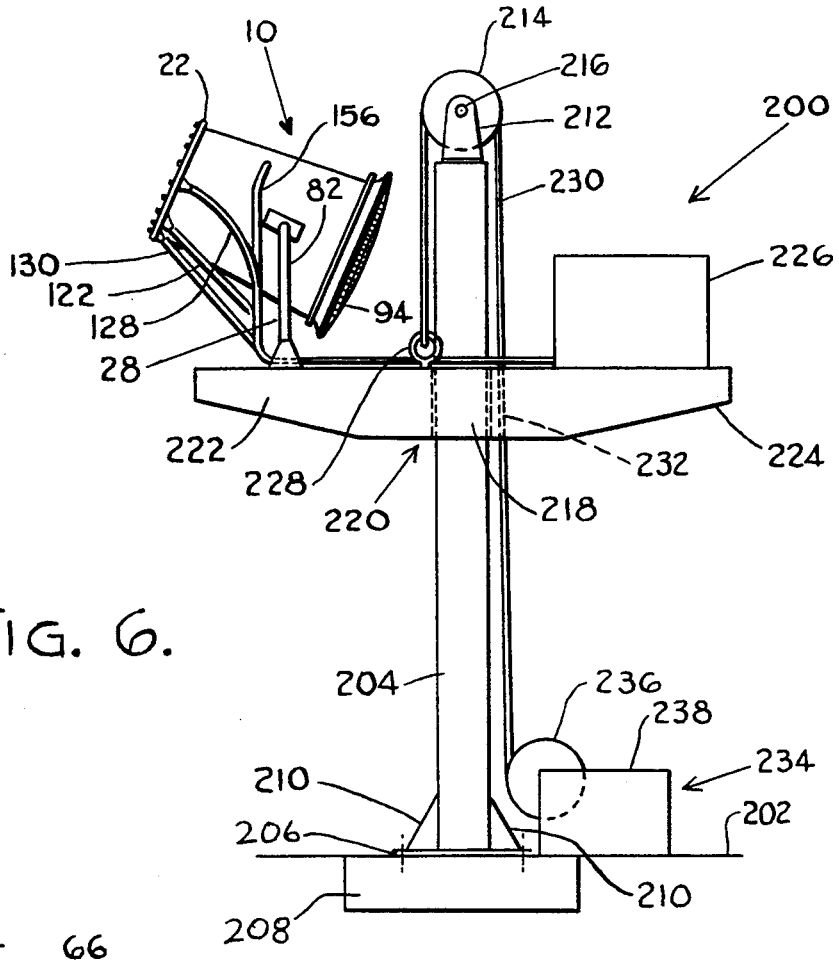

FIG. 6 is an elevational view of a support means 200 that provides for raising and lowering the snow making machine 10 of the present invention with respect to ground level 202.

Figure 7:
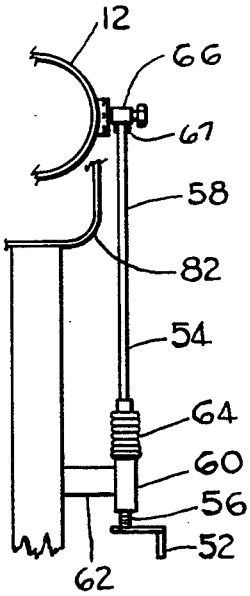

FIG. 7 is a view partly in schematic, partly in elevation of the means for adjusting the tilt angle of housing 12.

Figure 8:
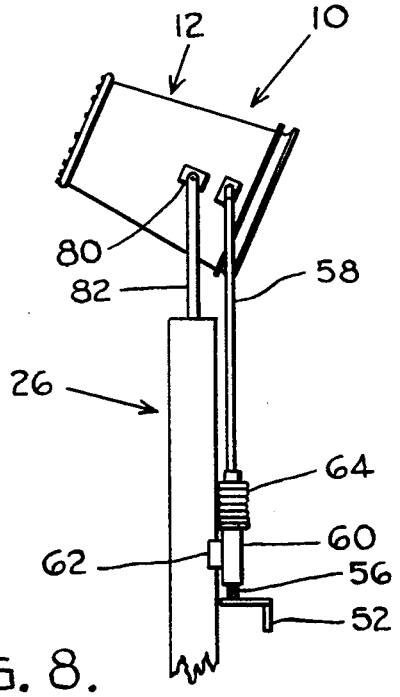

FIG. 8 is an elevational view, partly broken away of the tilt angle adjustment means shown in FIG. 7.

Figure 9:
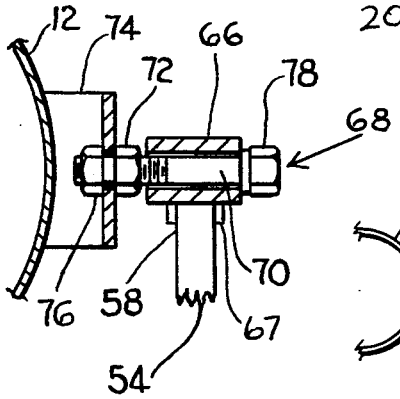

FIG. 9 is a view partly in cross-section showing part of the mechanism for adjusting the tilt angle of the housing 12.

DETAILED DESCRIPTION

Referring now to the drawings, FIGS. 1 to 3 and 5 to 9 show a snow making machine 10 according to the present invention comprising a housing 12 having a circular cross-section along and around a longitudinal axis of the housing 12 providing an enclosure for a fan unit 14 and a downstream nucleator 16 that serves to mix pressurized air from air line 18 and pressurized water from water line 20 to form a spray of ice crystal nuclei 21, as will hereinafter be explained in detail. An annularly shaped spray nozzle manifold 22 is provided circumferentially around the discharge outlet 12A. Manifold 22 supports a plurality of selectively actuatable water nozzle that provide for bathing the ice crystal nuclei 21 expelled through The discharge outlet 12A to thereby form artificial snow as the water covered ice crystal nuclei 27 travel through the freezing ambient atmosphere. This will hereinafter be explained in detail.

Figure 4:
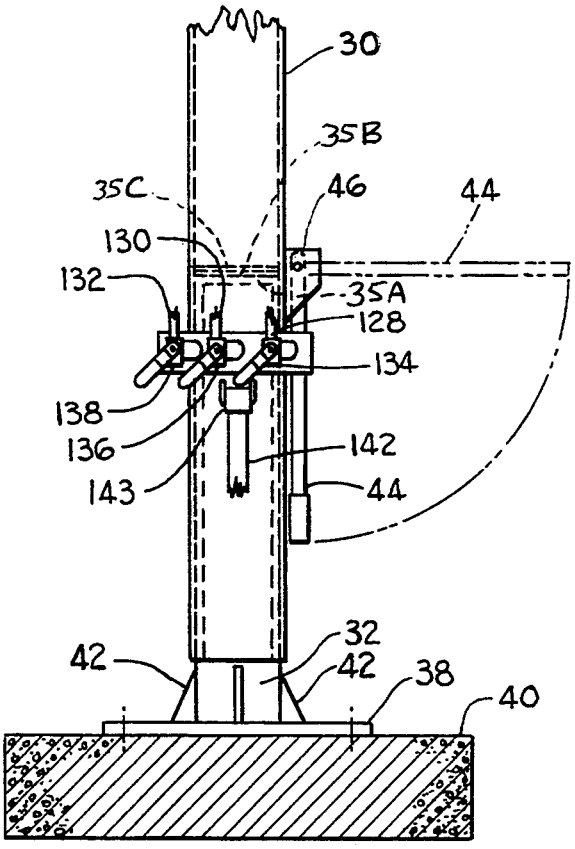
FIG. 4 is a front elevational views partly broken away, of the support means 26 shown in FIG. 3.
Figure 3:
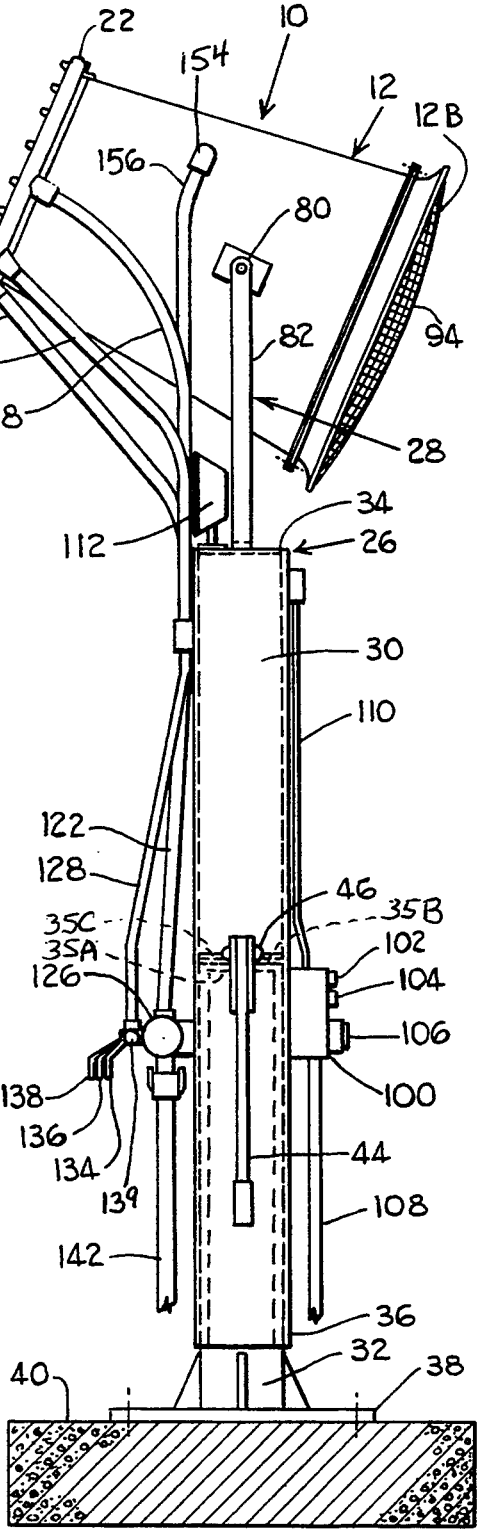
FIG. 3 is a side elevational view of the snow making machine 10 shown in FIG. 1 pivotably and rotatably mounted on a support means 26.

As particularly shown in FIGS. 3 and 4, housing 12 is pivotally and rotatably mounted to a support means 26 comprising a yoke 28 supported on an open ended cylinder 30 in coaxial alignment with a post 32. Although the support means 26 is shown as a tower, it is contemplated by the scope of the present invention that the snow making machine 10 can also be mounted on a portable support means that can be moved from one location to another as needed. This is well known to those of ordinary skill in the art.

Cylinder 30 has an upper end closed by cylinder plate 34 supporting yoke 28 and an open, lower end 36. Post 32 extends vertically through a portion of the inner passage of cylinder 30 with the upper end of post 32 closed by plate 35A and supports a wear pad 35B, preferably made of an elastomer material, such as nylon. Pad 35B contacts an inner plate 35C welded or otherwise suitably secured inside cylinder 30 at a position normal to the inner passage thereof (pad 35B and plates 35A and 35C are shown in dashed lines in FIGS. 3 and 4). This provides for cylinder 30, yoke 28 and snow making machine 10 to be rotatable about the vertical axis of post 32. The lower end of post 32 is mounted to a horizontal plate 38 by any suitable means such as welding and the like, and plate 38 is bolted or otherwise secured to a concrete foundation block 40. A plurality of gussets 42 connect between post 32 and mounting plate 38 and add vertical stability to support post 32.

Block 40 is preferably a pre-cast concrete member that is moved to a desired location and buried in an excavated hole (not shown) adjacent to a section of a ski slope and the like intended to be covered by artificial snow made by the snow making machine 10 of the present invention. Alternatively, block 40 can be formed by pouring a sufficient quantity of a cementitous mixture into a form (not shown) constructed in the excavation. After the cement has sets plate 38 and post 32 are secured to the block 40 in a known manner. Or the lower end of post 32 can be positioned in the form and then joined to block 40 as the cementitious mixture hardens around the post 32.

As shown in FIGS. 3 and 4, a handle bar 44 is pivotally mounted to cylinder 30 by a bracket 46 to provide for rotating cylinder 30 and yoke 28 supporting the snow making machine 10 about the vertical axis of post 32. When bar 44 is pivoted into an extended position (dashed lines in FIG. 4), perpendicular to the axis of cylinder 30, an operator (not shown) is able to rotate cylinder 30 through an annular extent of 360 degrees about the axis of post 32 to aim the yoke 28 and associated snow making machine 10 in a desired direction for covering a particular section of a ski slope 48 with artificial snow 50 (FIG. 5). With the snow making machine 10 aimed in the desired direction, bar 44 is folded back to a position adjacent to cylinder 30.

FIGS. 7 to 9 further show the means for adjusting the tilt angle of housing 12 to thereby regulate the angle of the discharge of the snow making machine 10. The tilt means comprises a hand crank 52 mounted to the distal end of a rod member aligned generally parallel with support means 26, and having a threaded section 56 extending part way along the length of rod 54 from the hand crank 52 towards an opposite, proximal end 58. Part of the threaded section 56 is received inside an internally threaded sleeve 60 that is connected to cylinder 30 by bracket 62. A universal joint (not shown) is preferably provided along the length of rod 54 to help prevent the threaded section 56 from binding inside the threaded sleeve 60.

A bellows 64 is preferably disposed around the threaded section 56 of rod number 54 serve as a sleeve member and to serve as a sleeve member and protect the threads. Bellows 64 is clamped to rod 54 at the upper end of bellows 64 while the lower end is left open and positioned around sleeve 60 to provide relative rotational movement there between. The proximal end 58 of rod 54 is pivotally connected to tube 66 through pivot 67. Tube 66 is in turn disposed at a position normal to the rod 54 with a threaded bolt 68 extending through the passage provided by tube 66 and in a rotatable relationship therewith. The threaded shaft 70 of bolt 68 mates with a first nut 72 suitably secured to the outside side wall of a U-shaped channel member 74, welded to the housing 12. A second nut 76 is secured to the inside of channel 74 and along with first nut 72 holds bolt 68 secured to channel 74 while enabling tube 66 to freely rotate about the axis of bolt 68 with tube 66 held in place by bolt head 78. Thus, the tilt angle of housing 12 comprising the snow making machine 10 is adjusted by appropriate turning motion of crank 52 which adjusts the threaded relationship between the threaded section 56 of rod member 54 and sleeve 60 to thereby move rod 54 and pivotally attached tube 66 in a direction parallel and laterally offset with respect to longitudinal axis of support means 26. This causes tube 66 to contact bolt 68 connected to housing 12 by channel 74 which creates a moment around the axis provided by pivot pins 80 connecting between the upper ends of spaced apart yoke arms 82 and housing 12 to adjust the tilt angle of housing 12 by adjusting the rotatable relationship between tube 66 and bolt 68. Preferably, the range of the tilt angle adjustment is between about +50 degrees above a horizontal plane to about −20 degrees below the horizontal.

It should be understood that it is within the scope of the present invention that the tilt angle of housing 12 can also be varied by means of a worm gear mechanism (not shown) wherein the proximal end 58 of rod 54 is threaded to provide a worm wheel that meshes with a worm gear mounted to housing 12, as is well known to those of ordinary skill in the art. In the alternative, the tilt angle of housing 12 can be varied by means of an electronically powered actuator means (not shown) connected between the housing 12 and one of the yoke arms 82, as is well known to those of ordinary shill in the art.

Figure 1:
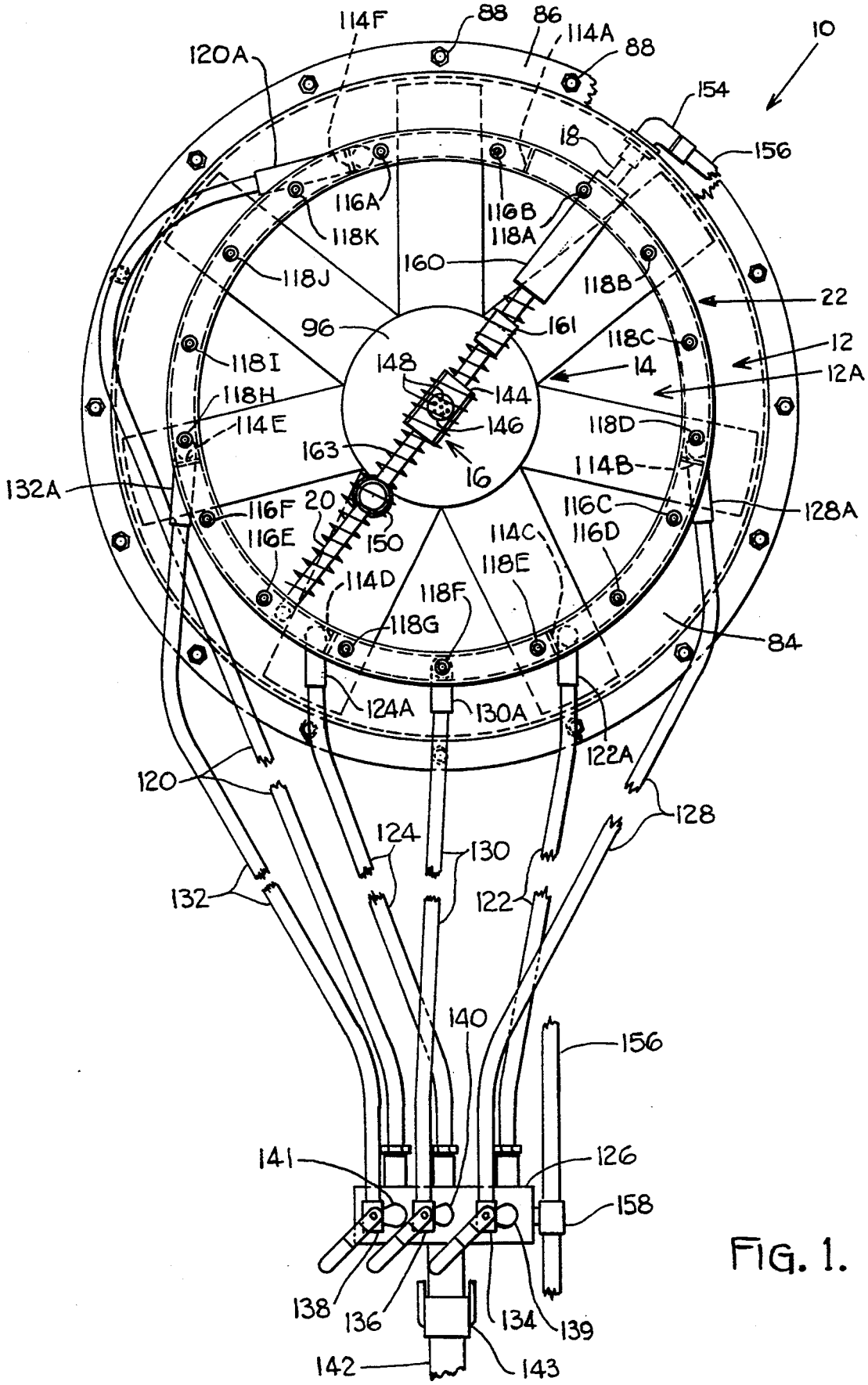
Figure 2:
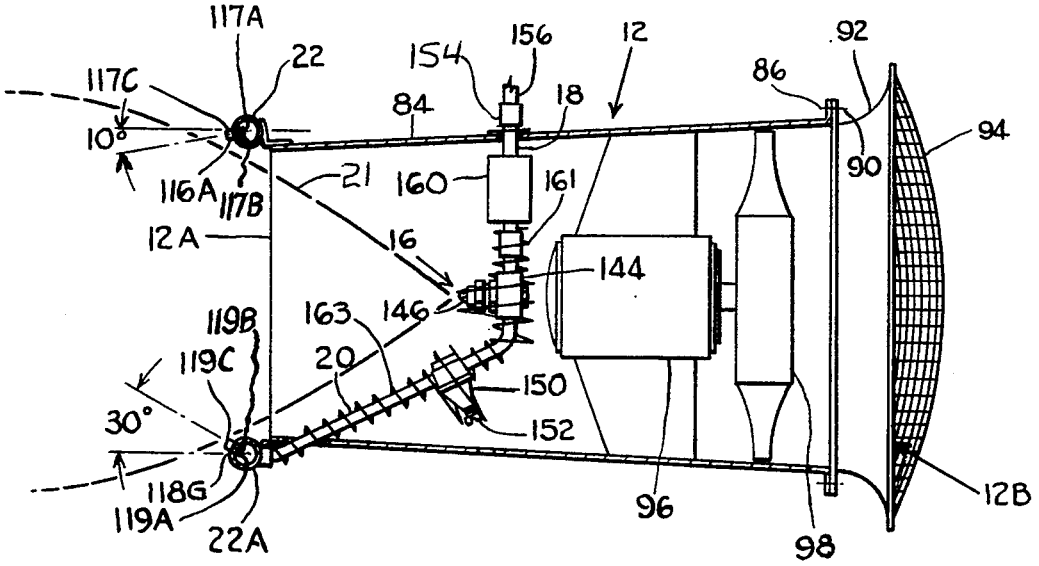
FIG. 2 is a partial side view of the snow making machine with a portion of housing 12 removed.

Referring now to the snow making machine 10 shown in FIGS. 1 to 3, housing 12 has the fan unit 14 and the nucleator 16 disposed therein to provide for forming and propelling a spray of ice crystal nuclei 21 out through the discharge opening 12A of housing 12, as will be presently described in detail. Housing 12 has a frusto-conical section 84 having a first, larger diameter with a planar annular flange 86 attached by bolts 88 to the peripheral extent of flange 90 of a rear intake section 92, wherein the frusto-conical section 84 tapers downwardly and inwardly toward the longitudinal axis and a second, smaller diameter providing the discharge outlet 12A. The inlet opening 12B (FIG. 2 and 3) of the intake section 92 of housing 12 is preferably covered by a coarse mesh screen 94 to minimize the likelihood of injury to the operator and also to prevent leaves, twigs, and other like debris from being drawn into the machine. An alternate embodiment of housing 12 that is not shown comprises a cylindrical section (not shown) provided at an intermediate location between the intake section 92 and a downstream frusto-conical section (now shown) attached to the cylindrical section and leading to the discharge outlet 12A.

As shown in FIGS. 1 and 2, fan unit 14 comprises an electric motor 96 driving a fan blade 98 having an array of radial blades rotatable about the longitudinal axis of the housing 12 to produce a substantially unidirectional air flow exiting the discharge outlet 12A. An electrical breaker box 100 (FIG. 3) having an "on" button 102, an "off" button 104 and a circuit breaker switch 106 is mounted on cylinder 30 of support means 26 with a power supply cable 108 feeding from an electrical power supply (not shown) to the box 100 and with a power cord 110 running from box 100 to the electric motor 96 to thereby power the fan unit 14. Box 100 is provided at a height so that the operator can manipulate the circuit breaker switch 106 to energize and de-energize the on and off buttons 102 and 104 from ground level. A safety light 112 is mounted on cylinder plate 34 and is suitably fed by power from electrical box 100. Light 112 is preferably turned on whenever the snow making machine 10 is operating to illuminate the immediate area around machine 10 for the benefit of the operator as well as people skiing or otherwise recreating in the immediate area of the machine 10.

As particularly shown in FIGS. 1, 2, 3 and 5, mounted adjacent the periphery of the discharge outlet 12A of housing 12 provided by the second diameter of the frusto-conical section 84, is the annularly shaped spray nozzle manifold 22 having a plurality of interior baffles 114A to 114F that segregate manifold 22 into six (6) sections. Manifold 22 also has connected thereto the water nozzles which are divided into primary water nozzles 116A to 116F and secondary water nozzles 118A to 118K. As particularly shown in FIG. 2, nozzle 116A and 118G are provided in a recessed position in the spray nozzle manifold 22 to help unthaw the water nozzles upon start-up. These nozzles are representations of all the nozzles 116A to 116F and 118A to 118K, and by way of example, it can clearly be seen that nozzle 116A is provided with a terminal upstream open end 117A and a threaded extension portion 117B that mates with a threaded opening in the spray nozzle manifold 22 to recess nozzle 116A a sufficient depth so that only the nozzle tip 117C provided with a spray orifice (not shown) extends beyond the outside wall of manifold 22 (FIG. 2). That way, the water moving through the inside passage 22A of manifold 22 serves to warm the nozzle 116A to a sufficient degree thereby rapidly unthawing the nozzle if it has become frozen during a period of non-use. Representative secondary nozzle 118G is provided with a similar terminal upstream open end 119A and a threaded extension portion 119B to recess its nozzle tip 119C in manifold 22 to provide for unthawing tip 119C. The water nozzles 116A to 116F and 118A to 118K shown in FIGS. 1 to 3 are 60 degree full cone, spiral nozzles of a well known commercially available type that can, for example, be acquired from Spray Systems, Inc., as their HH series.

As shown with reference to the orientation of FIG. 1, the primary water nozzles are separated into three groups comprised of two primary nozzles each. A first group comprising primary nozzles 116A and 116B is located between baffles 114A and 114F centered around about an upper, 12:00 o'clock position around the annular extent of spray nozzle manifold 22, a second group indicated as nozzles 116C and 116D is located between baffles 114B and 114C centered around about the 4:00 o'clock position and a third group indicated as nozzles 116E and 116F is located between baffles 114D and 114E centered around about the 8:00 o'clock position. Disposed in the manifold 22 between the three groups of primary water nozzles are three groups of secondary water nozzles. Secondary water nozzles 118A, 118B, 118C and 118D are mounted in manifold 22 between baffles 114A and 114B while three secondary water nozzles, indicated as nozzles 118E, 118F and 118G are mounted in the manifold 22 between baffles 114C and 114D. Finally, there are four secondary water nozzles, indicated as nozzles 118H, 118I, 118J and 118K mounted in the spray nozzle manifold 22 between baffles 114E and 114F.

As shown in FIGS. 1, 3 and 4, spray nozzle manifold 22 is supplied by three main water hoses, indicated as hoses 120, 122 and 124, feeding from a main water manifold 126 mounted to support means cylinder 30, and three secondary water hoses, indicated as 128, 130 and 132 that connect between respective sections of spray water manifold 22 having the secondary water nozzle groups 118A to 118D, 118E to 118G and 118H to 118K and associated respective 3-way valves 134, 136 and 138 connected to the main water manifold 126 by fittings 139, 140 and 141. Main water manifold 126 is itself connected to an external water supply (not shown) by a main feeder hose 142 attached to the water manifold 126 by coupling 143. Thus, when the water pumping system (not shown) for the snow making machine 10 is actuated, water is fed to the main water manifold 126 through main feeder hose 142 to in turn automatically supply water to main water hose 120 feeding primary nozzles 116A and 116B located between baffles 114A and 114F, main water hose 122 feeding primary nozzles 116C and 116D located between baffles 114B and 114C and main water hose 124 feeding primary nozzles 116E and 116F located between baffles 114D and 114E.

The three secondary water hoses 128 to 132, are fed by selectively actuating valves 134 to 138 to draw water off the main water manifold 126 and thereby supply a secondary water shower through nozzles 118A to 118K to augment the shower generated by the primary water nozzles 116A to 116F. In that respect, when valve 134 is turned to an "in line" position (not shown) with the valve handle turned up and parallel to the axis of the valve housing as viewed in FIG. 1, water is tapped off the main water manifold 126 and fed to hose 128 through valve fitting 139 to thereby supply water nozzles 118A to 118D segregated in manifold 22 by baffles 114A and 114B. The second water valve 136 is turned to an "in line" position (not shown) to tap water off the main water manifold 126 through fitting 140 to feed water to secondary water hose 130 and thereby supply water nozzles 118E, 118F and 118G segregated in manifold 22 by baffles 114C and 114D. Finally, the third water valve 138 is turned to an "in line" position (not shown) to tap water off the main water manifold 126 through fitting 141 to supply water to secondary water hose 132 and thereby feed water nozzles 118H to 118K segregated in manifold 22 by baffles 114E and 114F. That way, when snow making machine 10 is actuated to produce artificial snow, a bulk primary water shower is automatically directed into the air flow exiting the discharge outlet 12A of housing 12 by the primary water nozzle 116A to 116F. Then, depending on the ambient temperature and relative humidity, additional groups of secondary water nozzles 118A to 118D, 118E to 118G and 118H to 118K can be selectively actuated by respective valves 134, 136 and 138. The precise number of water nozzles, both primary and secondary, is not critical to the present invention so long as the quantity of bulk water droplets, for example in gallons per minute (GPM), is able to be transported by the generated air flow and deposited a sufficient distance from the snow making machine 10 and has sufficient hang time to freeze the water droplets. In addition to being dependent on the velocity of the generated air flow, sufficient freezing of the bulk water droplets through the ancient atmosphere relies on the temperature and relative humidity of the ambient atmosphere.

Figure 1A:
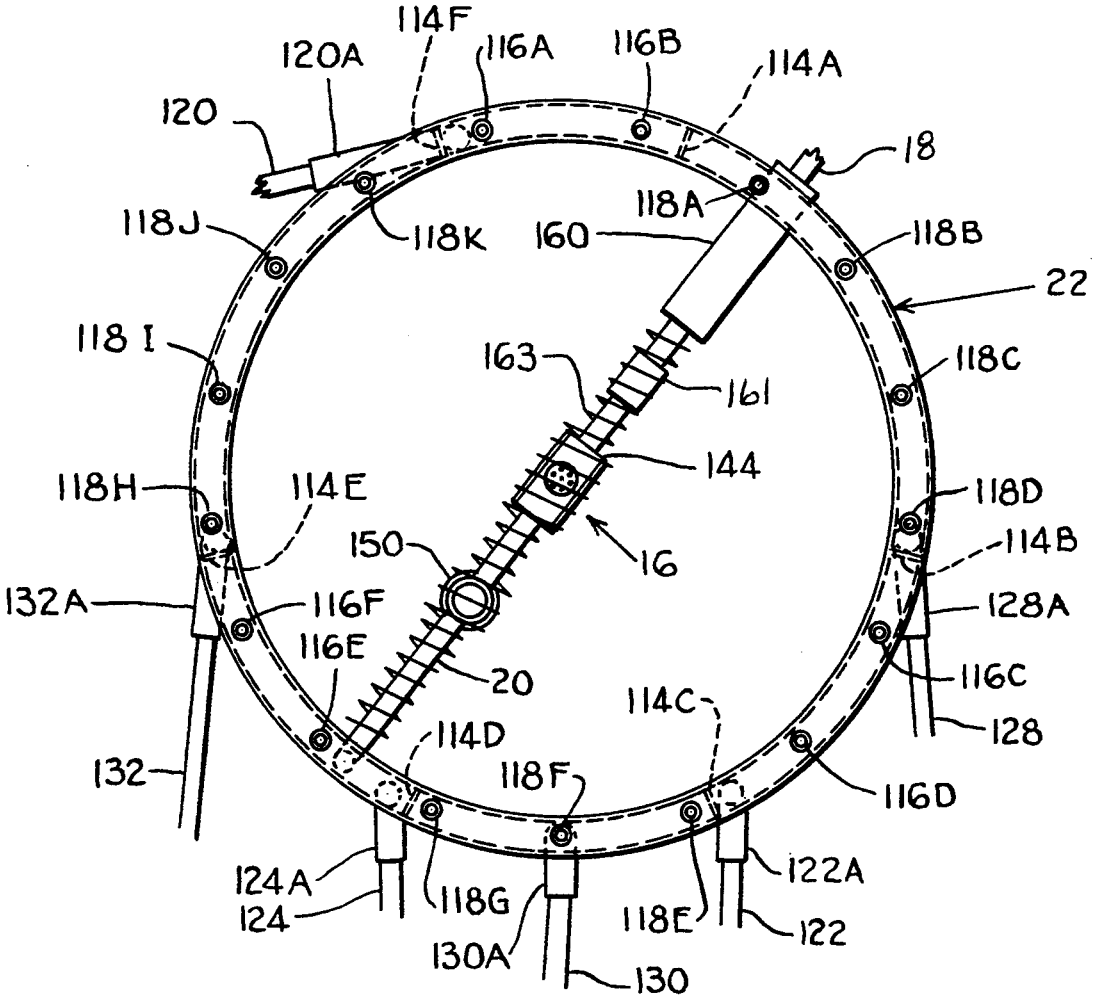

As shown in FIGS. 1 and 1A, the location of the hose fittings 120A to 124A that connect respective water hoses 120 to 124 to spray nozzle manifold 22 and hose fitting 128A to 132A that connect respective water hoses 128 to 132 to manifold 22 are positioned proximate a respective baffle. That way, when the water supply is turned off and the main water feeder hose 142 is disconnected from manifold 126 at coupling 143, any residual water in a manifold section corresponding to the main water hoses 120 to 124 will drain by gravity from the manifold 22 and flow out through the manifold coupling 143. Similarly, when any one of the 3-way valves 134 to 138 is turned to an "off position" (not shown) with the valve handle turned down and parallel to the axis of the valve housing, any residual water in a manifold section corresponding to the respective secondary water hoses 128 to 132 will drain by gravity from the manifold 22 and out through the valves 134 to 138. This prevents residual water from freezing and damaging the hoses, manifold and nozzles. By way of example, primary water hose 120 which serves to feed primary nozzles 116A and 116B centered at the upper 12:00 o'clock position between baffles 114A and 114F, is connected to fitting 120A entering manifold 22 adjacent to baffle 114F. Fitting 120A has a somewhat downwardly directed incline so that virtually all remaining residual water left in nozzles 116A and 116B and the correspondence section of manifold 22 drains back through the main water hose 120 when water hose 142 is disconnected from manifold 126 at coupling 143.

As shown in FIGS. 1 and 2, the nucleator 16 is mounted inside housing 12 along the longitudinal axis thereof and at a position directly adjacent to and downstream from fan unit 14. Nucleator 16 comprises housing 144 leading to an expansion chamber 146 having a dome shaped head provided with a plurality of openings 148 in communication with the inside of housing 144. Nucleator housing 144 is fed from opposite sides by the compressed air line 18 and water line 20 wherein the compressed air and pressurized water then move in an axial direction and converge in the expansion chamber 146. There, the air and water unite. The compressed air expands in chamber 146 which cools the air to below the freezing temperature so that the two fluids are expelled out through the openings 148 as an atomized spray that forms into ice crystal nuclei 21 by the time they have travelled from nucleator 16 to the discharge outlet 12A of housing 12. The ratio of compressed air to water mixed in nucleator 16 can vary from about 22:1 to 50:1, and preferably about 37:1 to 45:1. Preferably, nucleator water feed line 20 is tapped directly into spray nozzle manifold 22 at the manifold section supporting primary water nozzles 116E and 116F, between baffles 114D and 114E. Thus, nucleator water line 20 provides water to the nucleator 16 whenever the snow making machine 10 and primary water nozzles 116E to 116F are fed with water, as previously discussed in detail.

Nucleator water line 20 is provided with an in-line water pressure regulator 150 having a pressure adjustment screw 152. An opening (not shown) is provided in the frusto-conical section 84 of housing 12 directly below regulator 150. This enables an operator to pre-adjust the water pressure leaving regulator 150 by turning screw 152. Regulator 150 enables water pressure to be adjusted between a range of about 30 psi to about 90 psi, the pressure being preselected according to local ambient temperatures and humidity conditions.

As shown in FIG. 2, air line 18 connects to nucleator housing 144 at a position directly opposite water line 20 and leads to an elbow fitting 154 that joins to an external air hose 156 held in position by bracket 158 mounted to water manifold 126 and supplied with compressed air from an external pressurized air source (not shown). Air line 18 is provided with an in-line heater 160 that provides for warming the compressed air before the air reaches nucleator housing 144 and an intermediate one-way check valve 161 that prevents water back feed into heater 160 and air line 18 from nucleator 16. Heater 160 can comprise a winding of heating coils (not shown) powered by an electrical lead from the electrical breaker box 100 and serves to heat the compressed air in line 18 to prevent freezing in nucleator 16 where the heated air mixes with pressurized water from water line 20, as previously discussed. As the compressed air enters the expansion chamber 146, the air expands and cools. It is imperative that the air be heated to a sufficiently high temperature so that the expansion derived cooling in nucleator 16 and particularly expansion chamber 146 does not effect such low air temperatures as to cause freeze-up in the nucleator 16. Preferably, heater 160 warms the temperature of the compressed air to about 40° F. before the air enters nucleator housing 144.

As shown in FIGS. 1, 1A and 2, a spirally wound external heating coil 163 is provided wrapped around the water line 20 beginning at the spray nozzle manifold 22 and extending along the length of water line 20, around and over the regulator 150, nucleator housing 144 and expansion chamber 146, and over and around the air line 18 to check valve 161. External heating coil 163 is provided with power from the electrical breaker box 100 and serves to warm water line 20, nucleator 16, air line 18 and check valve 161 to prevent freezing or to thaw out frozen components.

As shown in FIGS. 1 and 2, nucleator 16 is positioned inside the frusto-conical section 84 of housing 12, aligned along the longitudinal axis thereof. Nucleator 16 is spaced a substantial distance upstream from the bulk cold water shower provided by the plurality of water nozzles. The atomized air/water mixture shown in cross-section in FIG. 2 leaving nucleator 16 thus is able to freeze into a spray of ice crystal nuclei 21 that propagates in a wide angle round pattern diverging radially along and around the longitudinal axis of housing 12 towards the discharge outlet 12A to completely fill the area of the discharge outlet 12A without impinging on the inside wall of the frusto-conical section 84, thereby preventing ice build-up on the inside of housing 12. The frusto-conical section 84 has about a 5 degree taper with respect to the longitudinal axis and serves to equilibrate the internal cross-sectional area normal to the axis of housing 12 to provide a substantially similar area along a plane through the electric motor 96 as at the discharge outlet 12A. This helps maintain substantially the same air flow velocity leaving the discharge outlet 12A as is established upstream at the outlet side of the fan blade 98 of the fan unit 14. That way, substantially the total energy output from the fan unit 14 is efficiently used to propel and expel the wide angle round spray pattern of ice crystal nuclei 21 generated by nucleator 16 out through the discharge outlet 12A to throw the ice crystals 21 a substantial distance from the snow making machine 10.

The primary water nozzles 116A to 116F and the secondary water nozzles 118A to 118K are provided at various discharge angles in manifold 22 with respect to the periphery of the air flow exiting the housing outlet 12A. As previously mentioned, the water nozzles are preferably 60 degree full cone, spiral nozzle of a commercially known type, meaning that the spray orifice in the nozzle tip is provided with an outwardly tapering frusto-conical shape of 60 degrees. This provides a diverging spray of bulk water exiting the nozzle and injected into the air flow carrying the ice crystals 21. The various discharge angles are selected based on the angle of the nozzle discharge opening and the position of the nozzle around the annular extent of manifold 22 in order to compensate for the effects of gravity. Those nozzles positioned in spray nozzle manifold 22 at substantially more uppermost positions have lesser angles with respect to the longitudinal axis of housing 12 than the nozzles at lower annular positions. This provides for direct injection of the cold water shower emitted by the nozzles into the air flow with no reflection and thus no lost efficiency, as shown in FIG. 2 where representative lower nozzle 118G is positioned such that its orifice is at a 30 degree angle with respect to the axis of the periphery of the air flow leaving outlet 12A. The periphery of the air flow is essentially parallel with the housing 12 axis. Also, upper nozzle 116A is shown at a 10 degree angle with respect to the periphery of the air flow. Providing the water nozzles at various discharge angles thus serves to optimize dispersion of the bulk water droplets distributed throughout the ice crystal nuclei 21 as the two travel through the cold ambient air and to thereby ensure complete development of ice granules.

As shown in FIG. 2, and based on a 60 degree full cone, spiral nozzle, primary water nozzles 116A and 116B are preferably mounted in manifold 22 at about a 10 degree angle relative to the axis of housing 12, and nozzles 116C to 116F are preferably provided with about a 30 degree angle relative to the housing axis. Similarly, secondary water nozzles 118A and 118K are preferably mounted in manifold 22 at about a 10 degree angle relative to the axis of housing 12, nozzles 118B and 118J are preferably provided with about a 15 degree angle, nozzles 118C and 118I are preferably provided with about a 20 degree angle, nozzles 118D and 118H are preferably provided with about a 25 degree angle and nozzles 118E to 118G are provided with about a 30 degree angle. Thus, it can be seen that those primary and secondary water nozzles located at lower vertical positions around the annular extent of manifold 22 are provided with greater discharge trajectories to compensate for the effects of gravity while providing for direct injection into the air flow. This contributes to optimizing the travel time of the bulk water shower droplets through the ambient atmosphere which in turn benefits the commingling of the water droplets with the spray of ice crystal nuclei 21 to enhance the cooling of the droplets and subsequent seeding effect of the ice crystals 21 on the bulk water droplets to thereby form deposited ice granules. As the temperature of the ambient atmosphere approaches the freezing point, the ice granules may not be entirely frozen and there may be required a curing period to completely solidify the ice granules.

In Use

The snow making machine 10 of the present invention is used to make large quantities of high quality, granular snow when weather conditions permit. To make artificial snow, the housing 12 which is pivotally and rotatably mounted on the support means 26 is positioned so that the discharge outlet 12A is aimed in a desired direction and is provided with a correct discharge tilt angle to cover a particular section of a ski slope 48 with artificial snow 50 (FIG. 5). As shown in FIGS. 3 to 5, post 32 is mounted to a horizontal plate 38 that is secured to a pre-cast concrete foundation block 40 buried in an excavation hole (not shown) adjacent to a section of the ski slope 48. The discharge outlet 12A of housing 12 is aimed in a desired direction to cover the ski slope 48 with artificial snow 50 by pivoting handle bar 44 into an extended position (dashed lines in FIG. 4), perpendicular to the axis of cylinder 30. The operator is then able to walk the handle bar 44 and cylinder 30 around the axis of post 32 through an annular extent of 360 degrees to thereby move housing 12 attached to cylinder 30 by yoke 28 around the axis of post 32 to provide for aiming the housing outlet 12A. With the snow making machine 10 aimed in the desired direction, bar 44 is folded back to its original position adjacent to cylinder 30.

As shown in FIGS. 7 to 9, the tilt angle of the discharge outlet 12A is then adjusted by turning hand crank 52 in an appropriate direction. As previously discussed in detail, hand crank 52 is mounted to the distal end of rod member 54, generally parallel to the longitudinal axis of the support means 26 with the threaded section 56 adjacent to crank 52 received inside threaded sleeve 60. Sleeve 60 is attached to cylinder 30 by bracket 62 so that imparting a turning motion to hand crank 52 causes the threaded relationship between threaded section 56 of rod 54 to adjust with respect to sleeve 60 to move rod 54 up or down along the lateral motion line of rod 54. This causes tube 66 welded to the proximal end of rod 54 to move along the lateral motion line to contact bolt 68 extending through the inner passage of tube 66. Bolt 68 is secured to channel 74 welded to housing 12 and tube 66 is freely rotatable about the axis of bolt 68 such that up or down force on bolt 68 from appropriate motion of tube 66 in response to turning motion of crank 52 creates an appropriate moment around the axis provided by pivot pins 80 connecting between the spaced apart yoke arms 82 and housing 12 to thereby adjust the tilt angle of housing 12 and its discharge outlet 12A.

With the discharge outlet 12A of housing 12 positioned at a desired direction and at a desired tilt angle, the fan unit 14 and nucleator 16 are actuated along with the selectively actuatable water nozzle means. In that respect, the "on" button 102 provided on the electrical breaker box 100 is actuated to energize the electrical motor 96 which drives the fan blades 98 to produce a high volume air flow through the frusto-conical section 84 of housing 12 and exiting the discharge outlet 12A. The external pressurized air source (not shown) is then actuated to move pressurized air through the external air hose 156 and into air line 18 to feed pressurized air to the nucleator 16. Actuating the "on" button 102 also supplies electrical power to in-line heater 160 to thereby preheat the pressurized air entering nucleator housing 144, and energizes the external heating coil 163 (FIGS. 1, 1A and 2) to warm the water line 20 and regulator 150, nucleator housing 144 and mixing chamber 146 and part of air line 18 between nucleator 16 and check valve 161.

Finally, the water pumping system (not shown) is actuated to supply water to the main water manifold 126 via the main water feed hose 142. Main water manifold 126 in turn automatically supplies high pressure water at a pressure of between about 150 psi to about 450 psi to the primary water nozzles 116A to 116F mounted in the spray water manifold 22 via main water hoses 120 to 124. As previously discussed in detail, water hose 120 supplies water to primary nozzles 116A and 116B, water hose 122 supplies water to primary nozzles 116C and 116D and water hose 124 supplies water to primary nozzles 116E and 116F whenever the water pumping system is actuated. In addition, water line 20 leading to nucleator 16 taps into the spray water manifold 22 between baffles 114D and 114E that segregate primary spray nozzles 116E and 116F (as shown in FIG. 2). Thus, when the primary water nozzles 116A to 116F are provided with water, water is also supplied to the housing 144 of nucleator 16 with adjustable pressure regulator 150 cutting back on the water pressure to provide water at a pressure range of between 30 psi to 90 psi, and preferably about 64 psi. Housing 144 serves to feed this water into mixing chamber 146 where the water mixes with high pressure heated air fed into housing 144 from air line 18 to form an atomized air and water spray exiting the plurality of opening 148 in the dome shaped mixing chamber head in a wide angle round pattern. This atomized spray is propelled by the air flow from fan unit 14 in a diverging pattern that freezes into a spray of ice crystal nuclei 21 that fills the circular cross-section of the discharge outlet 12A without impinging on the inside surface of housing 12. In that respect, since the diverging pattern of ice crystal nuclei 21 does not impinge on housing 12, there is no problem with ice build-up reducing the volume air flow exiting the discharge outlet 12A.

As the wide angle round spray of ice crystal nuclei 21 moves through and out the discharge outlet 12A, the ice crystal nuclei 21 commingle with the bulk water droplets injected into the air flow by the primary water nozzles 116A to 116F, as previously discussed. Then depending on the ambient air temperature, the ice crystal nuclei 21 can be commingled with additional water from secondary water nozzles 118A to 118D from water hose 128 controlled by valve 134 attached to main water manifold 126 by fitting 139, secondary water nozzles 118E to 118G from water hose 130 controlled by valve 136 attached to main water manifold 126 by fitting 140 and secondary water nozzles 118H to 118K from water hose 132 controlled by valve 138 attached to main water manifold 126 by fitting 141. Thus, as the temperature of the ambient air decreases wherein water freezes more rapidly, larger quantities of bulk water shower are able to be commingled with the ice crystal nuclei 21 at a given relative humidity to thereby form fully developed ice granules.

In that respect, it is important to carefully regulate the number of actuated secondary water nozzles to ensure complete ice granule development without providing so much water that an ice slush is formed. At a relative humidity of 60 percent and between about 36° F. and 29° F. ambient air temperature, only the primary water nozzles 116A to 116F are actuated to produce a cold water spray of about 30 GPM. At a similar relative humidity and with the ambient air temperature between about 28° F. and 20° F., secondary water nozzles 118E to 118G controlled by valve 136 are actuated to provide an additional cold water spray of about 15 GPM, thereby producing a total cold water spray of about 45 GPM. As the ambient air temperature decreases to between about 17° F. to 13° F. secondary water nozzles 118A to 118D controlled by valve 134 or water nozzles 118H to 118K controlled by valve 138 are actuated to produce an additional cold water spray of about 31 GPM, thereby producing a total cold water spray of about 76 GPM. Finally, at the given relative humidity with an ambient air temperature lower than about 12° F., the remaining secondary water nozzles not already actuated are turned on to produce an additional cold water spray of about 31 GPM and thereby provide a total cold water spray of about 107 GPM.

The wide angle round spray pattern of atomized air and water leaving nucleator 16 and carried along housing 12 and out through the discharge outlet 12A by the high volume air flow generated by fan unit 14 is completely frozen into ice crystal nuclei 21 by the time the atomized air/water spray reaches discharge outlet 12A. There the ice crystal nuclei 21 are commingled with the cold water shower provided directly adjacent to the annular perimeter of discharge outlet 12A by the primary water nozzles 116A to 116F strategically positioned in groups uniformly spaced around the annular extent of manifold 22, as previously described in detail. As the nucleated ice crystals 21 commingle with the bulk water shower, the water droplets begin to cool through convection and evaporation. The ice crystals then served as seed nuclei to which the cooled water droplets attach and through further cooling freeze into ice granules. As shown in FIG. 5, the ice granules are thrown in an arcing trajectory to thereby cover a portion of the ski slope 48 with artificial snow 50.

With a sufficient amount of snow accumulated on the slope 48 to provide for the winter-time activity, such as skiing and the like, the snow making machine 10 of the present invention is turned off by first deactuating water pumping system supplying water to the spray nozzles and then nucleator 16 and by deactuating pressurized air source supplying pressurized air to nucleator 16. The "off" button 104 provided on the electrical breaker box 100 is also actuated to turn off the electrical power to the fan unit 14. In order to prevent freezing of residual water that may be present in the spray nozzles means and the spray water manifold 22, the main water feeder hose 142 is disconnected from water manifold 126 at coupling 143. This enables residual water in primary water nozzles 116A to 116F to drain through the respective water hoses 120 to 124, through water manifold 126 and out coupling 143. As shown in FIG. 2, water feed line 20 enables residual water in nucleator 16 to drain by gravity into the spray water manifold 22 and from there into the main feeder hose 142 and out coupling 143.

In those cases when the secondary water nozzles 118A to 118K have been used to augment the bulk water shower, these nozzles must be drained by turning the corresponding valve 134 to 138 to a drain position with the valve handle pointed in a downwardly direction (not shown), parallel to the axis of the valve body. In the alternative the snow making machine 10 of the present invention can remain actuated to produce artificial snow, and the coverage area can be changed by adjusting the directions of the discharge of the housing outlet 12A and the tilt angle of the outlet 12A, as has previously been described in detail. Thus, the operation of the snow making machine 10, including the discharge direction and tilt angle adjustments can be controlled by an operator from the ground level. This prevents the operator from having to climb the support means 26, which can be extremely dangerous in winter conditions when ice and snow make climbing a particularly hazardous job.

FIG. 6 shows the snow making machine 10 of the present invention, which has previously been described in detail with respect to FIGS. 1 to 5 and 7 to 9. However, in this drawing the snow making machine 10 is mounted on a support means 200 that provides for adjusting the vertical elevation or altitude of the snow making machine 10 above ground level 202. Support means 200 comprises a post 204 having a lower end secured to a plate 206 that is bolted to a pre-cast concrete block 208 buried in an excavation adjacent to the ski slope, in a similar manner as previously described with respect to FIGS. 3 and 4. A plurality of gussets 210 extend between plate 206 and post 204 for added stability.

The upper end of post 204 is provided with a U-shaped bracket 212 supporting a pulley wheel 214 for rotation about axle 216. A sleeve 218 having an inner passage is positioned for axial movement on post 204. Sleeve 218 and post 204 are provided with a cooperating key and keyway (not shown) that prevent the sleeve 218 from rotating about the axis of the post 204. Sleeve 218 is further provided with a cantilever means 220 having opposed cantilever arms 222 and 224 extending outwardly and normal to the axis of sleeve 218. Arm 222 is adapted to support the snow making machine 10 of the present invention while arm 224 supports a counter weight means, such as provided by an associated air compressor 226, connected to a suitable power source (not shown) to thereby provide pressurized air to the nucleator 16, as has been described in detail. An eye hook 228 is secured to arm 222 and has a cable 230 secured thereto. Cable 230 travels up one side of post 204 adjacent to arm 222 over the pulley wheel 214 and down the other side of post 204, through a passage 232 (shown in dashed lines in FIG. 6) in arm 224 directly opposite hook 228 and connects to a winch 234 comprising a wheel 236 driven by motor 238. Thus, it can be seen that by appropriate winding and unwinding of cable 230 by winch 234, the sleeve 218 and the cantilever means 220 supporting the snow making machine 10 and air compressor 226 is raised and lowered along the length of post 204. This can be particularly advantageous when maintenance must be performed on the snow making machine 10. Then, the winch 234 is actuated to lower the sleeve 218 and associated cantilever means 220 to move the snow making machine 10 towards the ground level 202 where an operator can perform maintenance on the machine 10. This keeps the operator from having to climb the post 204, which can be extremely unsafe during the winter months.

While this invention has been particularly described in connection with several preferred embodiments thereof, it is to be understood that these embodiments are by way of illustration and not limitation, and the scope of the appended claims should be construed as broadly as the prior art will permit.

What is claimed is:

1. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a water injector located around the periphery of the housing proximate the discharge outlet for injecting a water shower into the air flow exiting the discharge outlet; and d) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow, wherein the nucleator is provided inside the housing at a position spaced upstream from the discharge outlet and at a distance sufficient to enable the wide angle round spray of ice crystal nuclei to substantially fill the open area of the discharge outlet with the water shower commingling with the ice crystal nuclei to thereby form ice granules as the two travel through an ambient atmosphere.

2. The snow making machine of claim 1 wherein the water injector comprises a surrounding manifold provided adjacent to the discharge outlet, and wherein the manifold supports a plurality of water nozzles spaced at intervals along the extent of the manifold and wherein the manifold receives an external supply of water to thereby connect the water supply to the plurality of water nozzles which provide a primary cold water shower injected into the air flow exiting the discharge outlet propelled by the high-volume air flow, the primary water shower commingling with the ice crystal nuclei to thereby form ice granules as the two travel through an ambient atmosphere.

3. The snow making machine of claim 2, wherein the plurality of water nozzles comprise primary water nozzles positioned at spaced intervals along the surrounding extent of the manifold to provide for injecting a primary water shower into the air flow propelling the spray of ice crystal nuclei out through the discharge outlet.

4. The snow making machine of claim 3 wherein the water nozzles further comprise a plurality of secondary water nozzles disposed at intermediate locations in the manifold between the primary water nozzles to provide for injecting a secondary water shower into the air flow propelling the spray of ice crystal nuclei out through the discharge outlet.

5. The snow making machine of claim 4 wherein the plurality of secondary water nozzles are disposed in the manifold at various acute angles relative to the longitudinal axis of the housing, the angles of the secondary water nozzles increasing in magnitude from an uppermost position to a lowermost position along the surrounding extent of the manifold.

6. The snow making machine of claim 4 wherein the secondary water nozzles located at the intermediate positions between the primary water nozzles in the manifold are selectively actuatable to provide for injecting a variable quantity of the secondary water shower into the air flow exiting the discharge outlet.

7. The snow making machine of claim 3 wherein the primary water nozzles are disposed in the manifold so as to provide the primary water shower injected into the air flow exiting the discharge outlet at a variety of acute angles relative to the longitudinal axis of the housing.

8. The snow making machine of claim 2 wherein the water nozzles are provided with a discharge nozzle tip portion positioned directly proximate the peripheral extent of the air flow exiting the housing to inject the cold water shower into the air flow.

9. The snow making machine of claim 2 wherein the water nozzles are provided with a discharge nozzle tip portion comprising a discharge orifice having an outwardly extending taper that provides for injecting a spray of bulk water comprising the cold water shower into the air flow, and wherein the water nozzles are disposed in the manifold so as to provide the spray of bulk water injected into the air flow at a variety of acute angles relative to the longitudinal axis of the housing, the various acute angles being a function of the location of the water nozzle along the surrounding extent of the manifold and the outwardly extending taper of the discharge orifice.

10. The snow making machine of claim 2 wherein the water nozzles are recessed into the manifold with only a discharge nozzle tip portion extending beyond a plane of the manifold.

11. The snow making machine of claim 1 wherein the housing has a circular cross-section at the discharge outlet and the water injector comprises an annular manifold provided adjacent to the discharge outlet, the manifold supporting a plurality of water nozzles spaced at intervals around the annular extent of the manifold and receiving an external supply of water to thereby provide for injecting a cold water shower into the air flow exiting the discharge outlet.

12. The snow making machine of claim 11 wherein the water nozzles comprise primary water nozzles positioned at three primary locations, spaced at intervals around the annular extent of the manifold to provide for injecting a primary water shower into the air flow propelling the spray of ice crystal nuclei out through the discharge outlet.

13. The snow making machine of claim 12 wherein a first one of the three primary locations is centered at about an uppermost, 12:00 o'clock position along the annular extent of the manifold, a second one of the primary locations is centered at about a 4:00 o'clock position along the annular extent of the manifold and a third one of the primary locations is centered at about an 8:00 o'clock position along the annular extent of the manifold.

14. The snow making machine of claim 13 wherein the primary water nozzles located at the first primary location are provided at an angle of about 10 degrees relative to the longitudinal of the housing and wherein the primary water nozzles located at the second and third primary locations are provided at an angle of about 30 degrees relative to the longitudinal axis.

15. The snow making machine of claim, 12 wherein the water nozzles further comprise a plurality of secondary water nozzles disposed at intermediate locations in the manifold between the primary water nozzles to provide for injecting a secondary water shower into the air flow propelling the spray of ice crystal nuclei out through the discharge outlet.

16. The snow making machine of claim 15 wherein the plurality of secondary water nozzles are disposed in the manifold at various acute angles relative to the longitudinal axis of the housing, the angles of the secondary water nozzles increasing in magnitude from an uppermost position to a lowermost position along the annular extent of the manifold.

17. The snow making machine of claim 15 wherein the secondary water nozzles located at the intermediate positions between the primary water nozzles in the manifold are selectively actuatable to provide for injecting a variable, quantity of the secondary water shower into the air flow exiting the discharge outlet.

18. The snow making machine of claim 12 wherein the primary water nozzles are disposed in the manifold so as to provide the primary water shower injected into the air flow exiting the discharge outlet at a variety of acute angles relative to the longitudinal axis of the housing.

19. The snow making machine of claim 12 wherein there are two primary water nozzles provided at each of the three primary locations spaced at uniform intervals around the annular extent of the manifold.

20. The snow making machine of claim 11 wherein the water nozzles are recessed into the manifold with only a discharge nozzle tip portion extending beyond a plane of the manifold.

21. The snow making machine of claim 11 wherein the plurality of water nozzles have associated therewith drains for draining residual water therefrom when the water nozzles are not actuated.

22. The snow making machine of claim 1 wherein a support for the housing provides for selected rotational movement of the housing about a vertical rotation axis for directing the discharge outlet at an infinite number of annular directions around the rotation axis.

23. The snow making machine of claim 22 wherein the support comprises a post providing the rotation axis and disposed coaxially inside a cylinder, the cylinder having a closed upper end connected to the housing and an opposite open end receiving a portion of the post extending from the open end thereof, the post positioned inside the cylinder so that the cylinder is rotatable with respect to the post about the rotation axis for directing the discharge outlet of the housing at the infinite number of annular directions.

24. The snow making machine of claim 23 wherein a lower end of the post is mounted to a foundation with a portion of the post extending from the lower end positioned inside the cylinder in the coaxial relationship to provide for rotational movement of the housing.

25. The snow making machine of claim 24 wherein the foundation comprises a precast concrete block that is buried in a pre-dug excavation adjacent an area to be covered with snow produced by the snow making machine.

26. The snow making machine of claim 24 wherein the cylinder is provided with a handle that provides for rotating the cylinder with respect to the post and wherein the handle is pivotable into an extended position for rotating the cylinder and the housing to change the annular direction of the discharge outlet and wherein the handle is pivotable to a folded position adjacent to the cylinder when the annular direction of the housing is not intended to be adjusted.

27. The snow making machine of claim 24 wherein an actuator operable from ground level and operatively associated with the housing provides for adjusting the tilt angle of the housing about the pivot axis.

28. The snow making machine of claim 1 wherein a support for the housing provides for pivoting movement of the housing around a horizontal pivot axis, normal to the longitudinal axis of the housing to thereby adjust a tilt angle of the discharge outlet.

29. The snow making machine of claim 28 wherein the support comprises a yoke attached to the housing about the pivot axis to provide the pivoting movement of the housing.

30. The snow making machine of claim 29 wherein the yoke comprises a U-shaped member having spaced apart and upwardly extending arms attached to the housing at opposed positions along the pivot axis to provide for pivoting movement of the housing to adjust the tilt angle of the discharge outlet.

31. The snow making machine of claim 28 wherein the range of the tilt angle of the discharge outlet of the housing is between about −20 degrees below a horizontal plane to about +50 degrees above the horizontal plane.

32. The snow making machine of claim 1 wherein a support for the housing comprises a post having a lower end mounted in a foundation and a length of the post extending vertically upwardly from the lower end and through a sleeve that is movable along the post to provide for vertical up and down movement of the housing along a substantial portion of the length of the post to provide for accessing the housing from a lowered, ground level elevation when the sleeve is adjacent to the foundation and for discharging artificial snow when the housing is in a raised position along the length of the post, spaced a substantial distance from the foundation.

33. The snow making machine of claim 32 wherein the sleeve supports a beam having opposed cantilever sections extending from opposite portions of the sleeve with a first one of the cantilever sections supporting the housing and a second, opposite cantilever section supporting a counterweight that counterbalances the housing and wherein the post is provided with an altitude adjustor that provides for raising and lowering the sleeve and associated beam along the post.

34. The snow making machine of claim 33 wherein the counterweight is provided by a power supply operatively associated with the snow making machine.

35. The snow making machine of claim 1 wherein the nucleator comprises multiple openings spaced in a radial pattern around the longitudinal axis of the housing to provide for injecting an atomized mixture of compressed air and water into the air flow to thereby form the spray of ice crystal nuclei.

36. The snow making machine of claim 35 wherein a heater provides for pre-heating the compressed air prior to mixing with the water in the nucleator.

37. The snow making machine of claim 1 wherein a support for the housing provides for pivoting movement of the housing around a horizontal pivot axis normal to the longitudinal axis of the housing to thereby adjust a tilt angle of the discharge outlet of the housing and wherein the support further provides for rotational movement of the housing about a vertical rotational axis for directing the discharge outlet at an infinite number of annular directions around the rotational axis.

38. The snow making machine of claim 37 wherein the support for the housing comprises a yoke attached to the housing about the pivot axis to provide the pivoting movement of the housing around the pivot axis and wherein the support further comprises a post providing the rotation axis and having a lower end mounted to a foundation and a portion of a length of the post disposed coaxially inside a cylinder, the cylinder having a closed upper end supporting the yoke and an opposite open end receiving the post so that the cylinder is rotatable with respect to the post about the rotation axis for directing the discharge outlet at the infinite number of annular directions.

39. The snow making machine of claim 1 wherein the air flow generator comprises a fan having a motor and an operatively associated fan blade rotatable about the axis of the housing by the motor to provide for generating the air flow exiting the discharge outlet and wherein the motor faces the discharge outlet and the fan blade faces the inlet opening with the nucleator provided proximate the motor and at the position spaced upstream from the discharge outlet of the housing and at the distance sufficient to enable the wide angle round spray of ice crystal nuclei to substantially fill the open area of the discharge outlet.

40. The snow making machine of claim 1 wherein the air flow generator comprises a fan having a motor and an operatively associated fan blade rotatable about the longitudinal axis of the housing by the motor to provide for generating the air flow exiting the discharge outlet and wherein the nucleator is provided inside the housing proximate the fan, spaced upstream from the discharge outlet of the housing and at the distance sufficient to enable the wide angle round spray of ice crystal nuclei to substantially fill the open area of the discharge outlet.

41. A machine for making artificial snow, which comprises:

a) a housing having an inlet opening and a discharge outlet aligned along a longitudinal axis of the housing;

b) a fan comprising a motor an dan operatively associated fan blade disposed inside the housing with the fan blade rotatable about the longitudinal axis for generating a high-volume air flow exiting the housing at the discharge outlet wherein a discharge portion of the housing is provided with an inwardly tapered frusto-conical shape that reduces the cross-sectional area inside the housing in a manner so as to maintain a substantially constant velocity of the air flow moving through the housing and out of the discharge outlet;

c) a water injector located around the periphery of the housing proximate the discharge outlet for injecting water into the air flow exiting the discharge outlet; and d) a nucleator operatively associated with the housing to provide a spray of ice crystal nuclei propagating outwardly from the discharge outlet propelled by the air flow exiting the discharge outlet, wherein the nucleator is provided inside the housing at a position spaced upstream from the discharge outlet and at a distance sufficient to enable the wide angle round spray of ice crystal nuclei to substantially fill the open area of the discharge outlet with the water shower commingling with the ice crystal nuclei to thereby form ice as the two travel through an ambient atmosphere.

42. The snow making machine of claim 41 wherein the nucleator comprises multiple openings spaced in a radial pattern around the longitudinal axis to provide for injecting an atomized mixture of compressed air and water into the air flow to thereby form the spray of ice crystal nuclei.

43. The snow making machine of claim 42 wherein the housing has a circular cross-section at the discharge outlet and the water injector comprises an annular manifold provided adjacent to the discharge outlet, the manifold supporting a plurality of water nozzles spaced at intervals around the annular extent of the manifold and receiving an external supply of water to thereby provide for injecting a cold water shower into the air flow exiting the discharge outlet.

44. The snow making machine of claim 43 wherein the plurality of water nozzles are recessed into the manifold with only a discharge nozzle tip portion of the water nozzles extending beyond a plane of the manifold.

45. The snow making machine of claim 43 wherein the water nozzles are provided with a discharge nozzle tip portion positioned directly proximate the peripheral extent of the air flow exiting the housing to inject the cold water shower into the air flow.

46. The snow making machine of claim 43 wherein the water nozzles are provided with a discharge nozzle tip portion comprising a discharge orifice having an outwardly extending taper that provides for injecting a spray of bulk water comprising the cold water shower into the air flow and wherein the water nozzles are disposed in the manifold so as to provide the spray of bulk water injected into the air flow at a variety of acute angles relative to the longitudinal axis of the housing, the various acute angles being a function of the location of the water nozzle positioned around the annular extent of the manifold and the outwardly extending taper of the discharge orifice.

47. The snow making machine of claim 42 wherein a heater provides for pre-heating the compressed air prior to mixing with the water in the nucleator.

48. The snow making machine of claim 42 wherein the mixture of compressed air and water injected into the air flow generated by the fan is in a ratio of between about 22:1 to 50:1.

49. The snow making machine of claim 41 wherein the fan blade faces the inlet opening and the motor faces the discharge outlet with the frusto-conical shape of the discharge portion providing a cross-sectional area at the discharge outlet that is substantially similar to the open cross-sectional area inside the housing along a plane normal to the longitudinal axis intersecting the motor to thereby maintain the substantially constant velocity of the air flow moving through the housing and out the discharge outlet.

50. The snow making machine of claim 49 wherein the nucleator is provided inside the housing proximate the motor at the position spaced upstream from the discharge outlet.

51. A method of making artificial snow, which comprises:

a) generating a substantially unidirectional high-volume air flow inside a housing and existing at a discharge outlet;

b) providing a wide angle round spray of ice crystal nuclei propagating outwardly from a position spaced upstream from the discharge outlet a distance sufficient to enable the wide angle round spray of ice crystal nuclei to form a radial pattern diverging outwardly along and around the longitudinal axis of the housing propelled by the air flow exiting the discharge outlet to substantially fill the area of the discharge outlet; and c) injecting a cold water shower into the air flow exiting the discharge outlet, the cold water shower provided in a surrounding relationship around the circumference of the discharge outlet such that water droplets comprising the cold water shower commingle with the spray of ice crystal nuclei to thereby form ice granules as the water droplets and ice crystal nuclei travel through an ambient atmosphere.

52. The method of claim 51 wherein a surrounding manifold is provided adjacent to the discharge outlet to support a plurality of water nozzles spaced at intervals around the extent of the manifold and wherein the manifold receives an external supply of cold water thereby injecting the cold water shower into the air flow exiting the discharge outlet.

53. The method of claim 52 wherein the water nozzles are provided with a discharge nozzle tip portion comprising a discharge orifice having an outwardly extending taper that provides for injecting a spray of bulk water comprising the cold water shower into the air flow and wherein the water nozzles are disposed in the manifold so as to provide the spray of bulk water injected into the air flow at a variety of acute angles relative to the longitudinal axis of the housing, the various acute angles being a function of the location of the water nozzle positioned along the surrounding extent of the manifold and the outwardly extending taper of the discharge orifice.

54. The method of claim 52 wherein the cold water supply is provided by the manifold having the water nozzles recessed therein with the cold water moving through the manifold serving to provide for thawing the water nozzles upon start-up and to prevent the water nozzles from freezing as the water nozzles provide the spray of bulk water into the air flow.

55. The method of claim 52 including draining the plurality of water nozzles having associated therewith drains and draining residual water from the water nozzles when the water nozzles are non actuated.

56. The method of claim 51 wherein the wide angle round spray pattern of ice crystal nuclei is provided by a nucleator that comprises multiple openings spaced in a radial pattern around the longitudinal axis of the housing to provide for injecting an atomized mixture of compressed air and water into the air flow to thereby form the spray of icy crystal nuclei.

57. The method of claim 51 wherein the water nozzles are provided with a discharge nozzle tip portion positioned directly proximate the peripheral extent of the air flow exiting the housing to inject the cold water shower into the air flow.

58. The method of claim 51 including pivoting the housing around a horizontal pivot axis, normal to the longitudinal axis of the housing to thereby adjust a tilt angle of the discharge outlet.

59. The method of claim 51 including rotating the housing about a vertical rotation axis of the housing for directing the discharge outlet at an infinite number of annular directions around the rotation axis.

60. The method of claim 51 wherein a support for the housing provides for pivoting movement including pivoting movement of the housing around a horizontal pivot axis normal to the longitudinal axis of the housing to thereby adjust a tilt angle of the discharge outlet of the housing and further including rotating the housing about a vertical rotational axis for directing the discharge outlet at an infinite number of annular directions around the rotational axis.

61. The method of claim 51 including moving the housing along a support between a raised position above ground level to thereby provide for forming artificial snow and a lower position proximate the ground level to provide for accessing the housing.

62. In a machine for making artificial snow comprising a housing having an inlet opening and a discharge outlet provided along a longitudinal axis of the housing; an air flow generator disposed inside the housing for generating a high-volume air flow exiting the housing at the discharge outlet; a water injector located around the periphery of the housing proximate the discharge outlet for injecting a water shower into the air flow exiting the discharge outlet; and a nucleator operatively associated with the housing to provide a spray of ice crystal nuclei propagating outwardly from the discharge outlet of the housing, propelled by the air flow exiting the discharge outlet, the improvement comprising:

a surrounding manifold provided adjacent to the discharge outlet forming the water injector, the manifold receiving an external supply of water and supporting a plurality of water nozzles comprising primary water nozzles positioned at spaced intervals along the surrounding extent of the manifold and wherein the manifold connects the water supply to the plurality of primary water nozzles which provide for automatically injecting a primary water shower into the air flow and wherein the manifold connects the water supply to a plurality of secondary water nozzles disposed at intermediate locations in the manifold between the primary water nozzles, the secondary water nozzles being selectively actuatable to provide for injecting a secondary water shower into the air flow propelling the spray of ice crystals nuclei out through the discharge outlet.

63. The machine of claim 62 wherein the water nozzles are provided with a discharge nozzle tip portion positioned directly proximate the peripheral extent of the air flow exiting the housing to inject the cold water shower into the air flow.

64. The machine of claim 63 wherein the water nozzles are provided with a discharge nozzle tip portion comprising a discharge orifice having an outwardly extending taper that provides for injecting a spray of bulk water comprising the cold water shower into the air flow, and wherein the water nozzles are disposed in the manifold so as to provide the spray of bulk water injected into the air flow at a variety of acute angles relative to the longitudinal axis of the housing, the various acute angles being a function of the location of the water nozzle along the surrounding extent of the manifold and the outwardly extending taper of the discharge orifice.

65. The machine of claim 62 wherein the water nozzles are recessed into the manifold with only a discharge nozzle tip portion extending beyond a plane of the manifold.

66. In a machine for making artificial snow comprising a housing having an inlet opening and a discharge outlet provided along a longitudinal axis of the housing; an air flow generator disposed inside the housing for generating a high-volume air flow exiting the housing at the discharge outlet; a water injector located around the periphery of the housing proximate the discharge outlet for injecting a water shower into the air flow exiting the discharge outlet; and a nucleator operatively associated with the housing to provide a spray of ice crystal nuclei propagating outwardly from the discharge outlet of the housing, propelled by the high-volume air flow, the improvement comprising:

a heater that provides for pre-heating the compressed air prior to mixing with the water in the nucleator.

67. In a machine for making artificial snow comprising a housing having an inlet opening and a discharge outlet provided along a longitudinal axis of the housing: an air flow generator disposed inside the housing for generating a high-volume air flow exiting the housing at the discharge outlet; a water injector located around the periphery of the housing proximate the discharge outlet for injecting a water shower into the air flow exiting the discharge outlet; and a nucleator operatively associated with the housing to provide a spray of ice crystal nuclei propagating outwardly from the discharge outlet of the housing, propelled by the high-volume air flow, the improvement comprising:

the housing provided with a circular cross-section at the discharge outlet and the water injector comprising an annular manifold provided adjacent to the discharge outlet, the manifold supporting a plurality of water nozzles spaced at intervals around the annular extent of the manifold and receiving an external supply of water to thereby provide for injecting the water shower into the air flow exiting the discharge outlet and wherein the nucleator is provided inside the housing at a position spaced upstream from the discharge outlet and at a distance sufficient to enable the wide angle round spray of ice crystal nuclei to substantially fill the open area of the discharge outlet with the water shower commingling with the ice crystal nuclei to thereby form ice granules as the two travel through an ambient atmosphere.

68. The snow making machine of claim 67 wherein the water nozzles comprise primary water nozzles positioned at three primary locations, spaced at intervals around the annular extent of the manifold to provide for injecting a primary water shower into the air flow propelling the spray of icy crystal nuclei out through the discharge outlet.

69. The snow making machine of claim 68 wherein the water nozzles further comprises a plurality of secondary water nozzles disposed at intermediate locations in the manifold between the primary water nozzles to provide for injecting a secondary water shower into the air flow propelling the spray of ice crystal nuclei out through the discharge outlet.

70. The snow making machine of claim 69 wherein the plurality of secondary water nozzles are disposed in the manifold at various acute angles relative to the longitudinal axis of the housing, the angles of the secondary water nozzles increasing in magnitude from an uppermost position to a lowermost position along the annular extent of the manifold.

71. The snow making machine of claim 69 wherein the secondary water nozzles located at the intermediate positions between the primary water nozzles in the manifold are selectively actuatable to provide for injecting a variable quantity of the secondary water shower into the air flow exiting the discharge outlet.

72. The snow making machine of claim 68 wherein a first one of the three primary locations is centered at about an uppermost, 12:00 o'clock position along the annular extent of the manifold, a second one of the primary located is centered at about a 4:00 o'clock position along the annular extent of the manifold and a third one of the primary locations is centered at about an 8:00 o'clock position along the annular extent of the manifold.

73. The snow making machine of claim 72 wherein the primary water nozzles located at the first primary location are provided at an angle of about 10 degrees relative to the longitudinal axis of the housing and wherein the primary water nozzles located at the second and third primary locations are provided at an angle of about 30 degrees relative to the longitudinal axis.

74. The snow making machine of claim 68 wherein the primary water nozzles are disposed in the manifold so as to provide the primary water shower injected into the air flow exiting the discharge outlet at a variety of acute angles relative to the longitudinal axis of the housing.

75. The snow making machine of claim 68 wherein there are two primary water nozzles provided at each of the three primary locations spaced at uniform intervals around the annular extent of the manifold.

76. In a machine for making artificial snow comprising a housing having an inlet opening and a discharge outlet provided along a longitudinal axis of the housing: an air flow generator disposed inside the housing for generating a high-volume air flow exiting the housing at the discharge outlet; a water injector located around the periphery of the housing proximate the discharge outlet for injecting a water shower into the air flow exiting the discharge outlet; and a nucleator operatively associated with the housing to provide a spray of ice crystal nuclei propagating outwardly from the discharge outlet of the housing propelled by the high-volume air flow, the improvement comprising:

a support for the housing comprising a yoke attached to the housing about a pivot axis to provide pivoting movement of the housing around the pivot axis normal to the longitudinal axis of the housing to thereby adjust a tilt angle of the discharge outlet and wherein the support further comprises a post providing a rotation axis and having a lower end mounted to a foundation and a portion of a length of the post disposed coaxially inside a cylinder, the cylinder having a closed upper end supporting the yoke and an opposite open end receiving the post so that the cylinder is rotatable with respect to the post about the rotation axis for directing the discharge outlet at an infinite number of annular directions.

77. The snow making machine of claim 76 wherein the cylinder is provided with a handle that provides for rotating the cylinder with respect to the post and wherein the handle is pivotable into an extended position, substantially perpendicular to the rotation axis for rotating the cylinder and the housing to change the annular direction of the discharge outlet and wherein the handle is pivotable to a folded position adjacent to the cylinder when the annular direction of the housing is not intended to be adjusted.

78. The snow making machine of claim 76 wherein an actuating means operable from ground level and operatively associated with the housing provides for adjusting the tilt angle of the housing about the pivot axis.

79. In a machine for making artificial snow comprising a housing having an inlet opening and a discharge outlet provided along a longitudinal axis of the housing: an air flow generator disposed inside the housing for generating a high-volume air flow exiting the housing at the discharge outlet; a water injector located around the periphery of the housing proximate the discharge outlet for injecting a water shower into the air flow exiting the discharge outlet; and a nucleator operatively associated with the housing to provide a spray of ice crystal nuclei propagating outwardly from the discharge outlet of the housing propelled by the high-volume air flow, the improvement comprising:

a support for the housing comprising a post having a lower end mounted to a foundation and a length of the post extending vertically upwardly form the lower end and through a sleeve that is moveable along the post to provide for vertical up and down movement of the housing along a substantial portion of the length of the post to provide for accessing the housing from a lowered, ground level elevation when the sleeve is adjacent to the foundation and for discharging artificial snow when the housing is in a raised position along the length of the post, spaced a substantial distance from the foundation.

80. The snow making machine of claim 79 wherein the sleeve supports a beam having opposed cantilever sections extending from opposite portions of the sleeve with a first one of the cantilever sections supporting the housing and a second, opposite cantilever section supporting a counterweight that counterbalances the housing and wherein the post is provided with an altitude adjustor that provides for raising and lowering the sleeve and associated beam along the post.

81. The snow making machine of claim 80 wherein the counterweight is provided by a power supply operatively associated with the snow making machine.

82. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a water injector located around the periphery of the housing proximate the discharge outlet for injecting a water shower into the air flow exiting the discharge outlet; and d) a nucleator disposed inside the housing and comprising multiple openings spaced in a radial pattern around the longitudinal axis of the housing to provide for injecting an atomized mixture of compressed air and water into the air flow to thereby provide a wide angle round spray of ice crystal nuclei propagating outwardly in a radial pattern towards the discharge outlet of the housing, along and around the longitudinal axis thereof, propelled by the high-volume air flow and wherein a heater provides for pre-heating the compressed air prior to mixing with the water in the nucleator.

83. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow; and d) a manifold located around the periphery of the housing proximate the discharge outlet for injecting a water shower into the air flow exiting the discharge outlet, the manifold supporting a plurality of water nozzles spaced at intervals along a surrounding extent of the manifold and receiving an external supply of water to thereby connect the water supply to the plurality of water nozzles, wherein the plurality of water nozzles provide a primary cold water shower injected into the air flow exiting the discharge outlet propelled by the high-volume air flow, the primary water shower commingling with the ice crystal nuclei to thereby form ice granules as the two travel through the ambient air, and wherein the water nozzles are provided with a discharge nozzle tip portion comprising a discharge orifice having an outwardly extending taper that provides for injecting a spray of bulk water comprising the cold water shower into the air flow, and wherein the water nozzles are disposed in the manifold so as to provide the spray of bulk water injected into the air flow at a variety of acute angles relative to the longitudinal axis of the housing, the various acute angles being a function of the location of the water nozzle along the surrounding extent of the manifold and the outwardly extending taper of the discharge orifice.

84. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow; and d) a manifold located around the periphery of the housing proximate the discharge outlet for injecting a water shower into the air flow exiting the discharge outlet, the manifold supporting a plurality of water nozzles spaced at intervals along a surrounding extent of the manifold and receiving an external supply of water to thereby connect the water supply to the plurality of water nozzles, wherein the plurality of water nozzles provide a primary cold water shower injected into the air flow exiting the discharge outlet propelled by the high-volume air flow, the primary water shower commingling with the ice crystal nuclei to thereby form ice granules as the two travel through the ambient air, and wherein the water nozzles are recessed into the manifold with only a discharge nozzle tip portion extending beyond a plane of the manifold.

85. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow; and d) a manifold located around the periphery of the housing proximate the discharge outlet for injecting a water shower into the air flow exiting the discharge outlet, the manifold supporting a plurality of water nozzles spaced at intervals along a surrounding extent of the manifold and receiving an external supply of water to thereby connect the water supply to the plurality of water nozzles, wherein the plurality of water nozzles provide a primary cold water shower injected into the air flow exiting the discharge outlet propelled by the high-volume air flow, the primary water shower commingling with the ice crystal nuclei to thereby form ice granules as the two travel through the ambient air, and wherein the plurality of water nozzles comprise primary water nozzles position at spaced intervals along the surrounding extent of the manifold and disposed at a variety of acute angles relative to the longitudinal axis of the housing to provide for injecting a primary water shower into the air flow propelling the spray of ice crystal nuclei out through the discharge outlet.

86. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow; and d) a manifold located around the periphery of the housing proximate the discharge outlet for injecting a water shower into the air flow exiting the discharge outlet, the manifold supporting a plurality of water nozzles spaced at intervals along a surrounding extent of the manifold and receiving an external supply of water to thereby connect the water supply to the plurality of water nozzles, wherein the plurality of water nozzles provide a primary cold water shower injected into the air flow exiting the discharge outlet propelled by the high-volume air flow, the primary water shower commingling with the ice crystal nuclei to thereby form ice granules as the two travel through the ambient air, and wherein the plurality of water nozzles comprise primary water nozzles positioned at spaced intervals along the surrounding extent of the manifold to provide for injecting a primary water shower into the air flow propelling the spray of ice crystal nuclei out through the discharge outlet and wherein the water nozzles further comprise a plurality of secondary water nozzles disposed at intermediate locations in the manifold between the primary water nozzles to provide for injecting a secondary water shower into the air flow propelling the spray of ice crystal nuclei out through the discharge outlet.

87. The snow making machine of claim 86 wherein the plurality of secondary water nozzles are disposed in the manifold at various acute angles relative to the longitudinal axis of the housing, the angles of the secondary water nozzles increasing in magnitude from an uppermost position to a lowermost position along the surrounding extent of the manifold.

88. The snow making machine of claim 86 wherein the secondary water nozzles located at the intermediate positions between the primary water nozzles in the manifold are selectively actuatable to provide for injecting a variable quantity of the secondary water shower into the air flow exiting the discharge outlet.

89. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a water injector located around the periphery of the housing proximate the discharge outlet for injecting a water shower into the air flow exiting the discharge outlet; and d) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow wherein the housing has a circular cross-section at the discharge outlet and the water injector comprises an annular manifold provided adjacent to the discharge outlet, the manifold supporting a plurality of water nozzles spaced at intervals around the annular extent of the manifold and receiving an external supply of water to thereby provide for injecting a cold water shower into the air flow exiting the discharge outlet and wherein the water nozzles comprise primary water nozzles positioned at three primary locations, spaced at intervals around the annular extent of the manifold to provide for injecting a primary water shower into the air flow propelling the spray of ice crystal nuclei out through the discharge outlet.

90. The snow making machine of claim 89 wherein the water nozzles further comprise a plurality of secondary water nozzles disposed at intermediate locations in the manifold between the primary water nozzles to provide for injecting a secondary water shower into the air flow propelling the spray of ice crystal nuclei out through the discharge outlet.

91. The snow making machine of claim 90 wherein the plurality of secondary water nozzles are disposed in the manifold at various acute angles relative to the longitudinal axis of the housing, the angles of the secondary water nozzles increasing in magnitude from an uppermost position to a lowermost position along the annular extent of the manifold.

92. The snow making machine of claim 90 wherein the secondary water nozzles located at the intermediate positions between the primary water nozzles in the manifold are selectively actuatable to provide for injecting a variable quantity of the secondary water shower into the air flow exiting the discharge outlet.

93. The snow making machine of claim 89 wherein a first one of the three primary locations is centered at about an uppermost, 12:00 o'clock position along the annular extent of the manifold, a second one of the primary locations is centered at about a 4:00 o'clock position along the annular extent of the manifold and a third one of the primary locations is centered at about an 8:00 o'clock position along the annular extent of the manifold.

94. The snow making machine of claim 93 wherein the primary water nozzles located at the first primary location are provided at an angle of about 10 degrees relative to the longitudinal axis of the housing and wherein the primary water nozzles located at the second and third primary locations are provided at an angle of about 30 degrees relative to the longitudinal axis.

95. The snow making machine of claim 89 wherein there are two primary water nozzles provided at each of the three primary locations spaced at uniform intervals around the annular extent of the manifold.

96. The snow making machine of claim 89 wherein the primary water nozzles are disposed in the manifold so as to provide the primary water shower injected into the air flow exiting the discharge outlet at a variety of acute angles relative to the longitudinal axis of the housing.

97. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a water injector located around the periphery of the housing proximate the discharge outlet for injecting a water shower into the air flow exiting the discharge outlet;

d) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow; and e) a support that provides for selected rotational movement of the housing about a vertical rotation axis for directing the discharge outlet at an infinite number of annular directions around the rotation axis, wherein the support comprises a post providing the rotation axis and disposed coaxially inside a cylinder, the cylinder having a closed upper end connected to the housing and an opposite open end receiving a portion of the post extending from the open end thereof, the post positioned inside the cylinder so that the cylinder is rotatable with respect to the post about the rotation axis for directing the discharge outlet of the housing at the infinite number of annular directions.

98. The snow making machine of claim 97 wherein a lower end of the post is mounted to a foundation with a portion of the post extending from the lower end positioned inside the cylinder in the coaxial relationship to provide for rotational movement of the housing.

99. The snow making machine of claim 97 wherein the foundation comprises a precast concrete block that is buried in a pre-dug excavation adjacent to an area to be covered with snow produced by the snow making machine.

100. The snow making machine of claim 97 wherein the cylinder is provided with a handle that provides for rotating the cylinder with respect to the post and wherein the handle is pivotable into an extended position for rotating the cylinder and the housing to change the annular direction of the discharge outlet and wherein the handle is pivotable to a folded position adjacent to the cylinder when the annular direction of the housing is not intended to be adjusted.

101. The snow making machine of claim 97 wherein an actuator operable from ground level and operatively associated with the housing provides for adjusting the tilt angle of the housing about the pivot axis.

102. A machine for making artificial snow, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a water injector located around the periphery of the housing proximate the discharge outlet for injecting a water shower into the air flow exiting the discharge outlet;

d) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow; and e) a support that provides for pivotable movement of the housing around a horizontal pivot axis normal to the longitudinal axis of the housing to thereby adjust a tilt angle of the discharge outlet of the housing and wherein the support further provides for rotational movement of the housing about a vertical rotational axis for directing the discharge outlet at an infinite number of annular directions around the rotational axis, wherein the support comprises a yoke attached to the housing about the pivot axis to provide the pivotable movement of the housing around the pivot axis and wherein the support further comprises a post providing the rotation axis and having a lower end mounted to a foundation and a portion of a length of the post disposed coaxially inside a cylinder, the cylinder having a closed upper end supporting the yoke and an opposite open end receiving the post so that the cylinder is rotatable with respect to the post about the rotation axis for directing the discharge outlet at the infinite number of annular directions.

103. A machine for making artificial snows, which comprises:

a) a housing having an inlet opening and a discharge outlet provided along a longitudinal axis of the housing;

b) an air flow generator disposed inside the housing for generating a high-volume air flow exiting the housing at the discharge outlet;

c) a water injector located around the periphery of the housing proximate the discharge outlet for injecting a water shower into the air flow exiting the discharge outlet;

d) a nucleator disposed inside the housing and adopted to provide a wide angle round spray of ice crystal nuclei propagating outwardly in a radial pattern towards the discharge outlet of the housing, along and around the longitudinal axis thereof, propelled by the high-volume air flow; and e) a support for the housing that comprises a post having a lower end mounted in a foundation and a length of the post extending vertically upwardly from the lower end and through a sleeve that is moveable along the post to provide for vertical up and down movement of the housing along a substantial portion of the length of the post to provide for accessing the housing from a lowered, ground level elevation when the sleeve is adjacent to the foundation and for discharging artificial snow when the housing is in a raised position along the length of the post, spaced a substantial distance from the foundation.

104. The snow making machine of claim 103 wherein the sleeve supports a beam having opposed cantilever sections extending from opposite portions of the sleeve with a first one of the cantilever sections supporting the housing and a second, opposite cantilever section supporting a counterweight that counterbalances the housing and wherein the post is provided with an altitude adjustor that provides for raising and lowering the sleeve and associated beam along the post.

105. The snow making machine of claim 104 wherein the counterweight is provided by a power supply operatively associated with the snow making machine.

106. A machine for making artificial snow, which comprises:

a) a housing having an inlet opening and a discharge outlet aligned along a longitudinal axis of the housing;

b) a fan comprising a motor and an operatively associated fan blade disposed inside the housing with the fan blade rotatable about the longitudinal axis for generating a high-volume air flow exiting the housing at the discharge outlet, wherein a discharge portion of the housing is provided with an inwardly tapered frusto-conical shape that reduces the cross sectional area inside the housing in a manner so as to maintain a substantially constant velocity of the air flow moving through the housing and out the discharge outlet;

c) a water injector located around the periphery of the housing proximate the discharge outlet for injecting water into the air flow exiting the discharge outlet; and d) a nucleator operatively associated with the housing to provide a spray of ice crystal nuclei propagating outwardly from the discharge outlet propelled by the air flow exiting the discharge outlet, wherein the fan blade faces the inlet opening and the motor faces the discharge outlet with the frusto-conical shape of the discharge portion providing a cross-sectional area at the discharge outlet that is substantially similar to the open cross-sectional area inside the housing along a plane normal to the longitudinal axis intersecting the motor to thereby maintain the substantially constant velocity of the air flow moving through the housing and out the discharge outlet.

107. The snow making machine of claim 106 wherein the nucleator is provided inside the housing proximate the motor and at a position spaced upstream from the discharge outlet.

108. A machine for making artificial snow, which comprises:

a) a housing having an inlet opening and a discharge outlet aligned along a longitudinal axis of the housing;

b) a fan comprising a motor and an operatively associated fan blade disposed inside the housing with the fan blade rotatable about the longitudinal axis for generating a high-volume air flow exiting the housing at the discharge outlet, wherein a discharge portion of the housing is provided with an inwardly tapered frusto-conical shape that reduces the cross sectional area inside the housing in a manner so as to maintain a substantially constant velocity of the air flow moving through the housing and out the discharge outlet;

c) a water injector located around the periphery of the housing proximate the discharge outlet for injecting water into the air flow exiting the discharge outlet; and d) a nucleator operatively associated with the housing to provide a spray of ice crystal nuclei propagating outwardly from the discharge outlet propelled by the air flow exiting the discharge outlet, wherein the nucleator comprises multiple openings spaced in a radial pattern around the longitudinal axis to provide for injecting an atomized mixture of compressed air and water into the air flow to thereby form the spray of ice crystal nuclei.

109. The snow making machine of claim 108 wherein the housing has a circular cross-section at the discharge outlet and the water injector comprises an annular manifold provided adjacent to the discharge outlet, the manifold supporting a plurality of water nozzles spaced at intervals around the annular extent of the manifold and receiving an external supply of water to thereby provide for injecting a cold water shower into the air flow exiting the discharge outlet.

110. The snow making machine of claim 109 wherein the plurality of water nozzles are recessed into the manifold with only a discharge nozzle tip portion of the water nozzles extending beyond a plane of the manifold.

111. The snow making machine of claim 109 wherein the water nozzles are provided with a discharge nozzle tip portion positioned directly proximate the peripheral extent of the air flow exiting the housing to inject the cold water shower into the air flow.

112. The snow making machine of claim 109 wherein the water nozzles are provided with a discharge nozzle tip portion comprising a discharge orifice having an outwardly extending taper that provides for injecting a spray of bulk water comprising the cold water shower into the air flow and wherein the water nozzles are disposed in the manifold so as to provided the spray of bulk water injected into the air flow at a variety of acute angles relative to the longitudinal axis of the housing, the various acute angles being a function of the location of the water nozzle positioned around the annular extent of the manifold and the outwardly extending taper of the discharge orifice.

113. The snow making machine of claim 108 wherein a heater provides for pre-heating the compressed air prior to mixing with the water in the nucleator.

114. The snow making machine of claim 108 wherein the mixture of compressed air and water injected into the air flow generated by the fan is in a ratio of between about 22:1 to 50:1.

115. A method of making artificial snow, which comprises:

a) generating a substantially unidirectional high-volume air flow inside a housing and exiting at a discharge outlet thereof;

b) providing a wide angle round spray of ice crystal nuclei propagating outwardly from a position spaced upstream from the discharge outlet to form a radial pattern diverging outwardly and downwardly along and around a longitudinal axis of the housing propelled by the air flow exiting the discharge outlet; and c) injecting a cold water shower into the air flow exiting the discharge outlet, the cold water shower provided by a manifold positioned adjacent to and in a surrounding relationship around the circumference of the discharge outlet, wherein the manifold supports a plurality of water nozzles spaced at intervals around a surrounding extent of the manifold with the manifold receiving an external supply of cold water to thereby inject the cold water shower into the air flow exiting the discharge outlet such that the water droplets comprising the cold water shower commingle with the spray of ice crystal nuclei to thereby form ice granules as the water droplets and ice crystal nuclei travel through a freezing ambient atmosphere, wherein the water nozzles are provided with a discharge nozzle tip portion comprising a discharge orifice having an outwardly extending taper that provides for injecting a spray of bulk water comprising the cold water shower into the air flow and wherein the water nozzles are disposed in the manifold so as to provide the spray of bulk water injected into the air flow at a variety of acute angles relative to the longitudinal axis of the housing, the various acute angles being a function of the location of the water nozzle positioned along the surrounding extent of the manifold and the outwardly extending taper of the discharge orifice.

116. A method of making artificial snow, which comprises:

a) generating a substantially unidirectional high-volume air flow inside a housing and exiting at a discharge outlet thereof;

b) providing a wide angle round spray of ice crystal nuclei propagating outwardly from a position spaced upstream from the discharge outlet to form a radial pattern diverging outwardly along and around a longitudinal axis of the housing propelled by the air flow exiting the discharge outlet; and c) injecting a cold water shower into the air flow exiting the discharge outlet, the cold water shower provided by a manifold positioned adjacent to and in a surrounding relationship with respect to the circumference of the discharge outlet, wherein the manifold supports a plurality of water nozzles, each terminating in an upstream open end in fluid flow communication with an internal passage extending through the water nozzle to a discharge orifice and wherein the plurality of water nozzles are spaced at intervals around a surrounding extent of the manifold with the manifold receiving an external supply of cold water and wherein the manifold enables the water supply to enter each of the plurality of water nozzles through their respective open ends with the water flowing through the internal passages and exiting the respective discharge orifices to inject the cold water shower into the air flow exiting the discharge outlet such that the water droplets comprising the cold water shower commingle with the spray of ice crystal nuclei and thereby form ice granules as the water droplets and ice crystal nuclei travel through a freezing ambient atmosphere, wherein the cold water supply is provided by the manifold having the water nozzles recessed therein with the discharge orifice extending beyond the manifold so that the cold water moving through the manifold serves to provide for thawing the water nozzles upon start-up and to prevent the water nozzles from freezing as the water nozzles provide the spray of bulk water into the air flow.

117. A method of making artificial snow, which comprises:

a) generating a substantially unidirectional high-volume air flow inside a housing and exiting at a discharge outlet thereof;

b) providing a wide angle round spray of ice crystal nuclei propagating outwardly from a position spaced upstream from the discharge outlet to form a radial pattern diverging outwardly along and around a longitudinal axis of the housing propelled by the air flow exiting the discharge outlet;

c) injecting a cold water shower into the air flow exiting the discharge outlet, the cold water shower provided in a surrounding relationship around the circumference of the discharge outlet such that water droplets comprising the cold water shower commingle with the spray of ice crystal nuclei to thereby form ice granules as the water droplets and ice crystal nuclei travel through a freezing ambient atmosphere; and d) moving the housing along a support between a raised position above ground level to thereby provide for forming artificial snow and a lower position proximate the ground level to provide for accessing the housing.

118. In a machine for making artificial snow comprising a housing having an inlet opening and a discharge outlet provided along a longitudinal axis of the housing: an air flow generator disposed inside the housing for generating a high-volume air flow exiting the housing at the discharge inlet; a water injector located around the periphery of the housing proximate the discharge outlet for injecting a water shower into the air flow exiting the discharge outlet; and a nucleator operatively associated with the housing to provide a spray of ice crystal nuclei propagating outwardly from the discharge outlet of the housing, propelled by the high-volume air flow, the improvement comprising:

the housing having a circular cross-section at the discharge outlet and the water injector comprising an annular manifold provided adjacent to the discharge outlet, the manifold supporting a plurality of water nozzles spaced at intervals around the annular extent of the manifold and receiving an external supply of water to thereby provide for injecting the water shower into the air flow exiting the discharge outlet, wherein the water nozzles comprise primary water nozzles positioned at three primary locations, spaced at intervals around the annular extent of the manifold to provide for injecting a primary water shower into the air flow propelling the spray of icy crystal nuclei out through the discharge outlet.

119. The snow making machine of claim 118 wherein the water nozzles further comprise a plurality of secondary water nozzles disposed at intermediate locations in the manifold between the primary water nozzles to provide for injecting a secondary water shower into the air flow propelling the spray of ice crystal nuclei out through the discharge outlet.

120. The snow making machine of claim 119 wherein the plurality of secondary water nozzles are disposed in the manifold at various acute angles relative to the longitudinal axis of the housing, the angles of the secondary water nozzles increasing in magnitude from an uppermost position to a lowermost position along the annular extent of the manifold.

121. The snow making machine of claim 119 wherein the secondary water nozzles located at the intermediate positions between the primary water nozzles in the manifold are selectively actuatable to provide for injecting a variable quantity of the secondary water shower into the air flow exiting the discharge outlet.

122. The snow making machine of claim 118 wherein there are two primary water nozzles provided at each of the three primary locations spaced at uniform intervals around the annular extent of the manifold.

123. The snow making machine of claim 118 wherein a first one of the three primary locations is centered at about an uppermost, 12:00 o'clock position along the annular extent of the manifold, a second one of the primary located is centered am about a 4:00 o'clock position along the annular extent of the manifold and a third one of the primary locations is centered at about an 8:00 o'clock position along the annular extent of the manifold.

124. The snow making machine of claim 118 wherein the primary water nozzles are disposed in the manifold so as to provide the primary water shower injected into the air flow exiting the discharge outlet at a variety of acute angles relative to the longitudinal axis of the housing.

125. The snow making machine of claim 123 wherein the primary water nozzles located at the first primary location are provided at an angle of about 10 degrees relative to the longitudinal axis of the housing and wherein the primary water nozzles located at the second and third primary locations are provided at an angle of about 30 degrees relative to the longitudinal axis.

* * * * *